US010532376B2

(12) United States Patent
Zhang

(10) Patent No.: US 10,532,376 B2
(45) Date of Patent: Jan. 14, 2020

(54) DISPENSER FOR STORING AND ADVANCING A LIQUID

(71) Applicant: Derik (JiangSu) Industrial Co., LTD, ChangZhou (CN)

(72) Inventor: Shaoxiang Zhang, ChangZhou (CN)

( * ) Notice: Subject to any disclaimer, the term of this patent is extended or adjusted under 35 U.S.C. 154(b) by 71 days.

(21) Appl. No.: 15/828,082

(22) Filed: Nov. 30, 2017

(65) Prior Publication Data

US 2019/0022695 A1 Jan. 24, 2019

Related U.S. Application Data

(60) Provisional application No. 62/534,277, filed on Jul. 19, 2017.

(51) Int. Cl.

| | |
|---|---|
| ***B43K 5/06*** | (2006.01) |
| ***B05C 17/01*** | (2006.01) |
| ***A45D 34/04*** | (2006.01) |
| ***B05C 17/005*** | (2006.01) |
| *A46B 11/00* | (2006.01) |

(52) U.S. Cl.

CPC ..... *B05C 17/0133* (2013.01); *A45D 34/04* (2013.01); *B05C 17/00516* (2013.01); *B05C 17/00596* (2013.01); *A45D 2200/055* (2013.01); *A45D 2200/1009* (2013.01); *A46B 11/0055* (2013.01)

(58) Field of Classification Search

CPC ..... A45D 34/042; A45D 40/262; A45D 2200/055; A45D 2200/1009; A46B 11/0055; B05C 17/0136

USPC ..... 401/179, 180, 279

See application file for complete search history.

(56) References Cited

U.S. PATENT DOCUMENTS

| | | | | |
|---|---|---|---|---|
| 3,720,473 A | | 3/1973 | Nakata | |
| 4,592,745 A | * | 6/1986 | Rex | A61M 5/24 604/152 |
| 4,624,594 A | | 11/1986 | Sasaki et al. | |
| 4,719,825 A | | 1/1988 | Lahaye | |
| 5,007,757 A | * | 4/1991 | Iizuka | A45D 34/042 222/309 |
| 5,035,525 A | * | 7/1991 | Konose | A45D 34/042 401/205 |

(Continued)

FOREIGN PATENT DOCUMENTS

WO 01/01813 A1 1/2001

*Primary Examiner* — Jennifer C Chiang

(74) *Attorney, Agent, or Firm* — Robert A. Blaha; Smith Tempel Blaha LLC

(57) ABSTRACT

A dispenser with a transfer assembly is arranged to efficiently transfer a stored liquid from a reservoir in a body of the dispenser to an applicator. The transfer assembly includes an adapter, applicator base, piston and a bias member. The adapter is in contact with the body and has a central member with orifices to fluidly couple the applicator base to the reservoir. The applicator base is supported by and extends beyond the adapter. The applicator base forms a cavity for housing the piston and the bias member. A tubular member of the applicator base supports an applicator. The piston includes a passage that conveys the stored liquid from the cavity to the applicator. The bias member keeps the head of the piston against a surface of the central member. When stored liquid is under a pressure that exceeds a bias force, displacement of the piston, opens a seal.

20 Claims, 33 Drawing Sheets

(56) References Cited

U.S. PATENT DOCUMENTS

| | | | | | |
|---|---|---|---|---|---|
| 5,156,479 | A * | 10/1992 | Iizuka | A45D 34/042 | 401/151 |
| 5,176,461 | A * | 1/1993 | Kimura | A45D 19/02 | 401/273 |
| 5,180,245 | A * | 1/1993 | Iizuka | A45D 34/042 | 401/206 |
| 5,803,640 | A | 9/1998 | Nakajima et al. | | |
| 5,851,079 | A | 12/1998 | Horstman et al. | | |
| 6,702,158 | B2 * | 3/2004 | Kageyama | A45D 34/042 | 222/340 |
| 6,746,170 | B2 | 8/2004 | Delage | | |
| 6,793,431 | B1 | 9/2004 | Tsai | | |
| 6,986,620 | B2 | 1/2006 | Abbas | | |
| D543,703 | S | 6/2007 | Hsieh | | |
| D544,212 | S | 12/2007 | Hsieh | | |
| 7,309,185 | B2 | 12/2007 | Thorpe et al. | | |
| 7,374,359 | B1 | 5/2008 | Annerino et al. | | |
| 7,537,406 | B2 | 5/2009 | Kurek et al. | | |
| 7,631,645 | B2 | 12/2009 | Gayton et al. | | |
| 7,887,246 | B2 | 2/2011 | Hori | | |
| 8,021,068 | B2 * | 9/2011 | Shih | A45D 34/042 | 401/277 |
| 8,328,449 | B2 * | 12/2012 | Wightman | A45D 34/042 | 401/174 |
| 8,333,525 | B2 * | 12/2012 | Wightman | A45D 34/042 | 401/174 |
| 8,845,221 | B2 * | 9/2014 | Fukumoto | A45D 34/04 | 401/171 |
| 8,985,884 | B2 | 3/2015 | Nakamura et al. | | |
| 2016/0144395 | A1 | 5/2016 | Brugger | | |
| 2016/0286938 | A1 | 10/2016 | Ebeling | | |
| 2016/0338481 | A1 | 11/2016 | Lee | | |

* cited by examiner

DISPENSER FOR STORING AND ADVANCING A LIQUID

CROSS-REFERENCE TO RELATED APPLICATIONS

This application claims the benefit of provisional patent application, assigned application No. 62/534,277, filed on Jul. 19, 2017. The disclosure of the referenced provisional application is hereby incorporated by reference in its entirety.

TECHNICAL FIELD

The present dispenser relates, in general, to a liquid container suitable for delivering a stored liquid to an applicator.

BACKGROUND

Commercially available make-up devices are arranged with operator manipulated product delivery mechanisms and storage structures that make it difficult to efficiently advance a liquid product from a reservoir where the liquid product is stored to an applicator. These commercially available make-up devices have been criticized for requiring an excessive number of operator manipulation cycles before the liquid product is present at the surface of the applicator where it can be applied by the operator.

SUMMARY

An embodiment of a dispenser includes a transfer assembly coupled to a hollow body. The transfer assembly efficiently delivers a liquid from a reservoir in the hollow body to an applicator. A section of the transfer assembly is coupled to a complimentary support section of the hollow body. The transfer assembly is arranged with an adapter, an applicator base, a piston and a bias member. The adapter has a central member with orifices that fluidly couple an inlet of the adapter with an outlet of the adapter. The applicator base is supported by and extends from the adapter. The piston has a head portion that is enclosed within a cavity of the applicator base. The bias member is also arranged in the cavity of the applicator base and is in contact with the head portion of the piston.

BRIEF DESCRIPTION OF THE DRAWINGS

Embodiments of the dispenser can be better understood with reference to the following drawings. The components in the drawings are not necessarily to scale, emphasis instead being placed upon clearly illustrating the structures and principles of operation of the assemblies.

DESCRIPTION OF ILLUSTRATED EMBODIMENTS

Figure 1A:
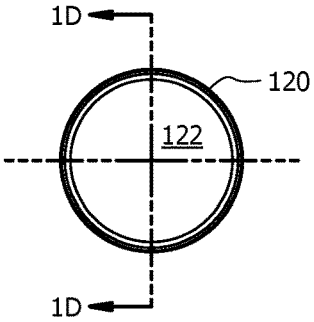
FIGS. 1A, 1B and 1C illustrate representative top, front, and bottom plan views of an embodiment of a dispenser.

In light of shortcomings with inefficient conventional cartridges, namely the inefficiency associated with transferring a liquid product from a reservoir where the liquid product is stored, to an applicator where the liquid product can be applied, improvements are desired.

As used in this document, the phrase "inefficient conventional cartridges" means commercially available assemblies that as packaged and sold include a liquid product that is accessed or available for application after at least fifty repetitive manipulations by an operator.

As used in this document, the phrase "cyclical modification of fluidic pressure" means the application of and the subsequent removal of a force against a liquid.

As used in this document, the phrase "less than about 10 cycles" means a range of an integer number of cycles from 1 to 11 cycles.

As used in this document, the phrase "less than about 20 cycles" means a range of an integer number of cycles from 1 to 22 cycles.

As used in this document the term "cycle" means the application of and the subsequent removal of a force.

In a preferred embodiment, the dispenser includes a pump assembly coupled to a hollow body. The hollow body includes a reservoir for storing a liquid. The pump assembly includes a mechanism that can be manipulated by an operator of the dispenser to direct a stored liquid in a reservoir within the hollow body in the direction of the transfer assembly.

The improved dispenser introduced and summarized herein, will be further described in conjunction with example embodiments as illustrated in the drawings. As briefly summarized, the improved dispenser includes a body that supports a transfer assembly and a pump assembly. The transfer assembly is in fluid communication with a reservoir in the body of the dispenser. The transfer assembly efficiently delivers a stored liquid in the reservoir to a surface of an applicator when the pump assembly is manipulated.

The transfer assembly consists of an adapter, an applicator base, a bias member and a piston. The transfer assembly is coupled to the body by a protective and close fitting sleeve or neck. The neck is arranged with an irregular outer surface that supports a removable cap. The cap encloses and protects an applicator that is supported by and in fluid communication with the transfer assembly. The neck is further arranged with an irregular inner surface that engages complimentary features of the body.

As assembled, the stored fluid in the reservoir is at or near ambient atmospheric pressure. Absent the introduction of external forces acting upon the stored liquid in the reservoir, a bias force provided by the bias member against the head portion of the piston prevents the flow or transfer of the stored liquid from the reservoir past the head portion of the piston and into the tubular member on its way through the applicator base to the applicator. Thus, when initially assembled and packaged, the passage through the piston is dry or devoid of the stored liquid.

A cylinder portion of the applicator base has a wall including an opening that is arranged to receive the tubular portion of the piston. The tubular portion of the piston includes a channel that enables fluid communication from the inlet of the adapter to an opening in the applicator base. The bias member is located in the applicator base. The bias member can be, for example, a helical steel spring. A head of the piston is arranged to closely contact a surface of the applicator base. Specifically, an opening in the head of the piston receives and contacts a central member of the adapter. When fluidic pressure is applied, for example by operation of the pump assembly advancing a threaded rod and a wiper, fluid passes through orifices in the central member of the adapter and contacts the face of the piston head. When the bias force is exceeded, the piston is displaced in a direction toward the applicator allowing the fluid to pass the seal formed by the opening in the head portion of the piston and the central member and enter the tubular portion of the piston. When fluidic pressure is unable to overcome a force exerted by the bias member against the piston head, the piston head reengages or contacts a sealing surface of the central member arranged between the inlet portion and the cylinder portion of the adapter. When this is the case, any fluid that has been displaced past the seal into the cavity of the piston remains in the cavity and is not returned to the reservoir.

Although the illustrated embodiments of the pump assembly include a pushbutton driven mechanism that resembles a manipulator of a "click" pen or mechanical pencil, it should be understood that alternative subassemblies may be used to push or otherwise advance the liquid in the reservoir toward and through the transfer assembly. For example, an alternative subassembly may include a manipulator that rotates to drive one or more elements into a reservoir to advance liquid toward and later through the transfer assembly. Other alternative pump assembly designs may use one or more rails or guides, pawls and ratchets, worm gears and wheels or other mechanisms alone or in combinations to advance a plunger or seal to advance the stored liquid in a reservoir toward the transfer assembly.

In the illustrated embodiments, the pump assembly includes a base, a pushbutton, a driver, a bias member and a coupler. The base receives a pushbutton in a first opening and has an irregular annular recess along an inner surface. The driver is located within and extends beyond the base. The driver has a tubular member and an annular member extending from a surface of the tubular member. A set of pins extend from a surface of the annular member. The coupler receives a bias member and a portion of the driver. The coupler has a head end arranged to contact a first end of the bias member and an opposed open end with an irregular annular surface. An opposed end of the bias member contacts the annular member of the driver. The irregular annular recess of the hollow base and the irregular annular surface of the coupler form a path for the pins to traverse.

In operation, displacement of a pushbutton of the pump assembly advances a wiper, which is mechanically coupled to the pump assembly. Specifically, linear displacement of the pushbutton advances the wiper into the reservoir in the direction of the transfer assembly. A press stroke of the pushbutton advances the wiper by a first distance. A release stroke of the pushbutton further advances the wiper into the reservoir. A bias force completes the release stroke and returns the pushbutton to a rest position. This displacement of the pushbutton cyclically increases and decreases pressure within the reservoir. Under fluid pressure, the piston in the transfer assembly moves toward and compresses the bias member. When the head portion of the piston moves away from a sealing surface in the transfer assembly, any residual air and thereafter liquid stored in the reservoir flows from the inlet of the adapter through a passage or channel in the piston to the outlet of the applicator base. Otherwise, the bias member keeps the piston sealed against a central member of the adapter, which prevents the flow or transfer of additional liquid into the transfer assembly. Accordingly, this arrangement prevents unintended emptying of the contents of the reservoir due to gravity or changes in ambient air pressure.

The base has an irregular annular recess along an inner surface. The driver has features that are located within and features that extend beyond the base. The driver has an annular member with pins extending therefrom. The coupler receives a respective bias member and a portion of the driver. The coupler has a head end that contacts a first end of the bias member. An opposed open end of the coupler has an irregular annular surface. The irregular annular recess of the base and the irregular annular surface of the coupler oppose each other to form a path for the pins to traverse as the driver rotates in response to linear manipulation of the pushbutton.

In operation, manipulation of the pushbutton advances the pins of the driver away from the irregular annular recess in the hollow base toward the irregular annular surface of the coupler. When the pins contact the coupler, the driver is rotationally advanced. The driver includes a slot at an open end that rotates a threaded rod. A wiper, connected to the threaded rod, is advanced into the reservoir in a direction toward the transfer assembly.

In an example embodiment, the pump assembly effectively eliminates harsh audible feedback often associated with conventional pushbutton manipulators. In this example embodiment, the pump assembly is arranged absent rotational interference of adjacent surfaces.

Alternatively, when an optional fixed sleeve is included, the improved pump assembly provides audible feedback when a longitudinal force applied to the pushbutton exceeds a bias force exerted by the bias member. A first "click" or "pop" is generated when the pushbutton is pressed in a direction into the body of the dispenser as the pushbutton directs the pins of the driver into contact with the irregular annular surface of the coupler. The driver rotates a first angular distance as the pins move along the irregular annular surface of the coupler. As the driver rotates highpoints or extensions of the cam surface on the annular member of the rotating driver are forced past highpoints or extensions along the opposed cam surface of the fixed sleeve. A second "click" or "pop" is generated as the pushbutton is released and the bias member directs the pins of the driver into contact with the irregular annular recess in the base. The driver further rotationally advances as the pins move along the surface of the irregular recess in the base. As the driver rotates highpoints or extensions of the cam surface on the annular member of the rotating driver are forced past highpoints or extensions along the opposed cam surface of the fixed sleeve.

The base and the pushbutton may be made from various plastics or other materials known for mechanical strength such as acrylonitrile butadiene styrene (ABS). The base is arranged to receive the pushbutton in a first opening. The base is further arranged with an irregular annular recess along an inner surface.

The driver and the coupler of the pump assembly can also be made from various plastics, such as polyoxymethylene (POM). The bias member, which can be embodied in a helical spring, can be made from hardened steel. Alternatively, the bias member may be made from non-ferrous metals or even plastic.

In the example embodiment, the pump assembly is fixed to a hollow body that defines a volume of a reservoir ($V_{res}$) suitable for storing a liquid product. The volume of the reservoir may be adjusted by increasing or decreasing the length and/or the inner diameter of the body between the transfer assembly and the pump assembly.

Some liquid products that may be stored in the reservoir include cosmetics such as concealers, glosses, mascaras, etc. Other non-cosmetic liquids may be stored in a reservoir of the hollow body. These alternative liquids include paints, sealers, suspensions, etc. Liquid products that react when exposed to air such as paints and sealers may require a cleaning or removal of dried product from the applicator and/or the piston to be suitable for more than a single application from the dispenser. However, liquid products can be prevented from fouling the channel in the piston, openings in the adapter base, and/or pores or respective openings in an applicator by placing the cap on the dispenser when the dispenser is not in use.

In an example embodiment, the driver has a tubular member with an annular member located between ends of the tubular member and extending from a surface of the tubular member. A set of pins extend from and are supported by the annular member. In this example embodiment, the pushbutton is arranged with a member or extension that contacts the annular member of the driver and a cavity that supports a closed end of the driver.

In an example embodiment, the coupler has a closed head end and an opposed open end with an irregular annular surface arranged about the open end. The closed or head end of the coupler receives and supports a first end of the bias member a second or opposed end of the bias member is in contact with the annular member of the driver. In an example embodiment, the coupler is fixed to the base. In this arrangement, the irregular annular recess in a wall of the base and the irregular annular surface of the coupler oppose each other and define a path for the pins of the driver to traverse.

When a longitudinal force applied to the pushbutton exceeds a bias force exerted by the bias member, the pins move from the irregular annular recess of the base to the irregular annular surface of the coupler. In this example embodiment, the tubular driver rotates as the pins follow the irregular annular surface of the coupler. Upon removal of the longitudinal force from the pushbutton the pins, in response to the bias force exerted by the bias member, move from the irregular annular surface of the coupler to the irregular annular recess of the base producing further rotation of the tubular driver.

In an example embodiment, the pump assembly further includes a wiper arranged to closely contact an inner surface of the reservoir within the body and a threaded rod. The threaded rod has a first end in contact with the wiper and an opposed end. The threaded rod extends through an opening in the head end of the coupler and is engaged in a slot of the tubular member of the driver. The threaded rod may be arranged with an annular stop proximal to the first end. In the example embodiment, the opening in the head end of the coupler is threaded to compliment the threads on the threaded rod.

In operation, the driver and the threaded rod rotate within the base and the coupler, which remain fixed to the body of the dispenser. The threaded rod advances into the reservoir in the direction of the applicator of the transfer assembly. The threaded rod advances a wiper, which directs a fluid stored in the reservoir toward and through an inlet of the transfer assembly and later to and through the applicator coupled to the transfer assembly.

Figure 1C:
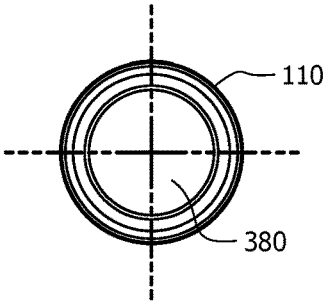
Figure 1B:
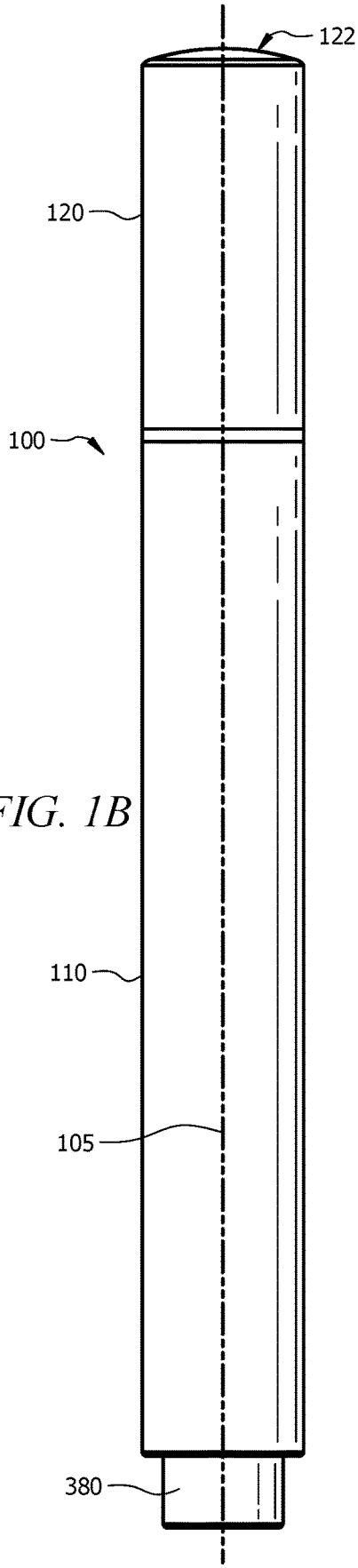

FIG. 1B shows a front plan view of a cylindrically-shaped dispenser 100. The dispenser 100 includes an elongated cylindrical body 110 generally symmetrical about a longitudinal axis 105 with a cap 120 proximal to a first end 111 (see FIG. 2) of the body 110 and a portion of a pushbutton 380 extending beyond an opposed end or base end 113 (see FIG. 2) of the body 110. The cap 120 (as further shown in FIG. 1D and in FIG. 2) has an open end and an opposed or closed end with a domed external surface 122. The cap 120 has an inward facing surface arranged with one or more ribs (not shown) proximal to the open end that closely fit a corresponding recess in the hollow neck 260. As shown in FIG. 1E, which is a front plan view of the dispenser 100 illustrated in FIGS. 1A, 1B and 1C with the cap 120 removed, the hollow neck 260 is connected to the body 110 and is arranged to receive a portion of and partially support an applicator 250 that extends therefrom.

The close fit or interference fit between the cap 120 and the hollow neck 260 enables the cap 120 to remain engaged with the body 110 until an operator desires to apply the contents of the dispenser 100. The cap 120 can be removed by grasping the cap 120 and the body 110 and applying an external force in a direction substantially parallel to the longitudinal axis 105 of the dispenser 100. In an example embodiment, the body 110, the cap 120 and the hollow neck 260 are made from a thermoplastic polymer such as polypropylene, while the pushbutton 380 is made from acrylonitrile butadiene styrene or ABS.

Figure 1D:
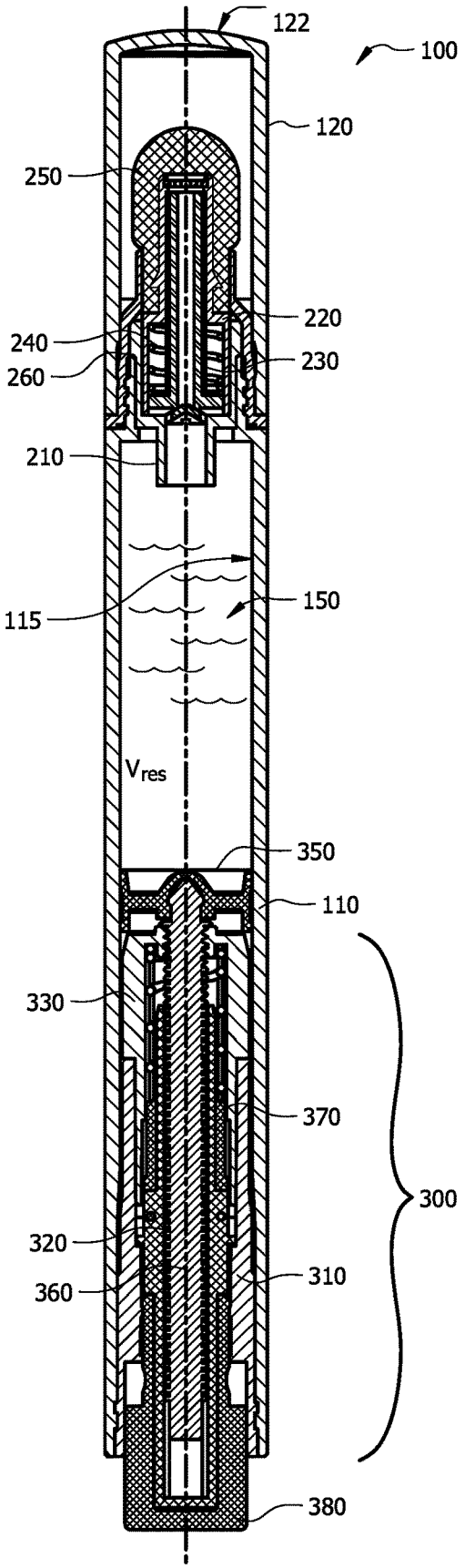
FIG. 1D is cross-sectional view in the direction of line 1D-1D of the dispenser illustrated in FIG. 1A.
Figure 1E:
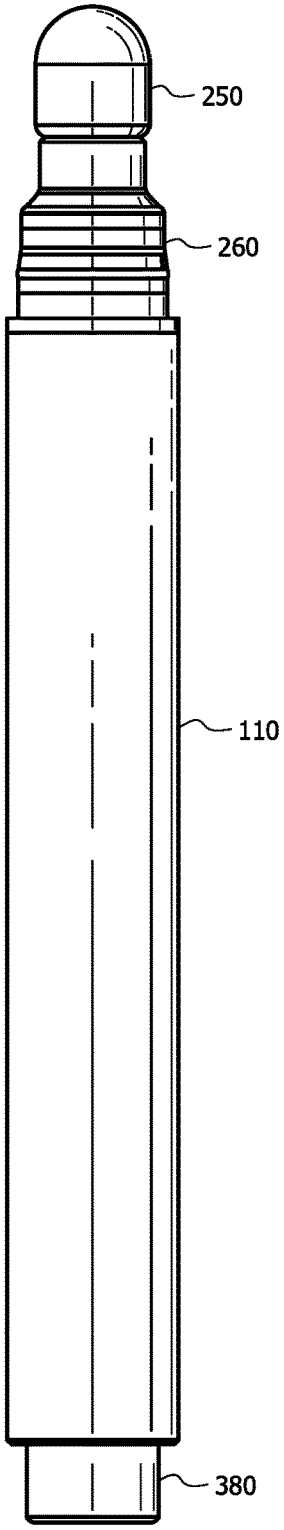
FIG. 1E is a front plan view of the dispenser illustrated in FIGS. 1A, 1B and 1C without a cap.

As shown in the bottom plan view of FIG. 1C and in FIG. 1D, which presents a cross-sectional view in the direction of line 1D-1D of the dispenser 100 illustrated in FIG. 1A, a portion of the pushbutton 380 extends beyond the body 110 and a base 310 coupled to an inner wall of the body 110 with a remaining portion of the pushbutton 380 including a member 385 (see FIG. 2) extending from the base end 113 into the body 110 where the member 385 (see FIG. 2) engages an inward facing surface of the base 310.

Figure 2:
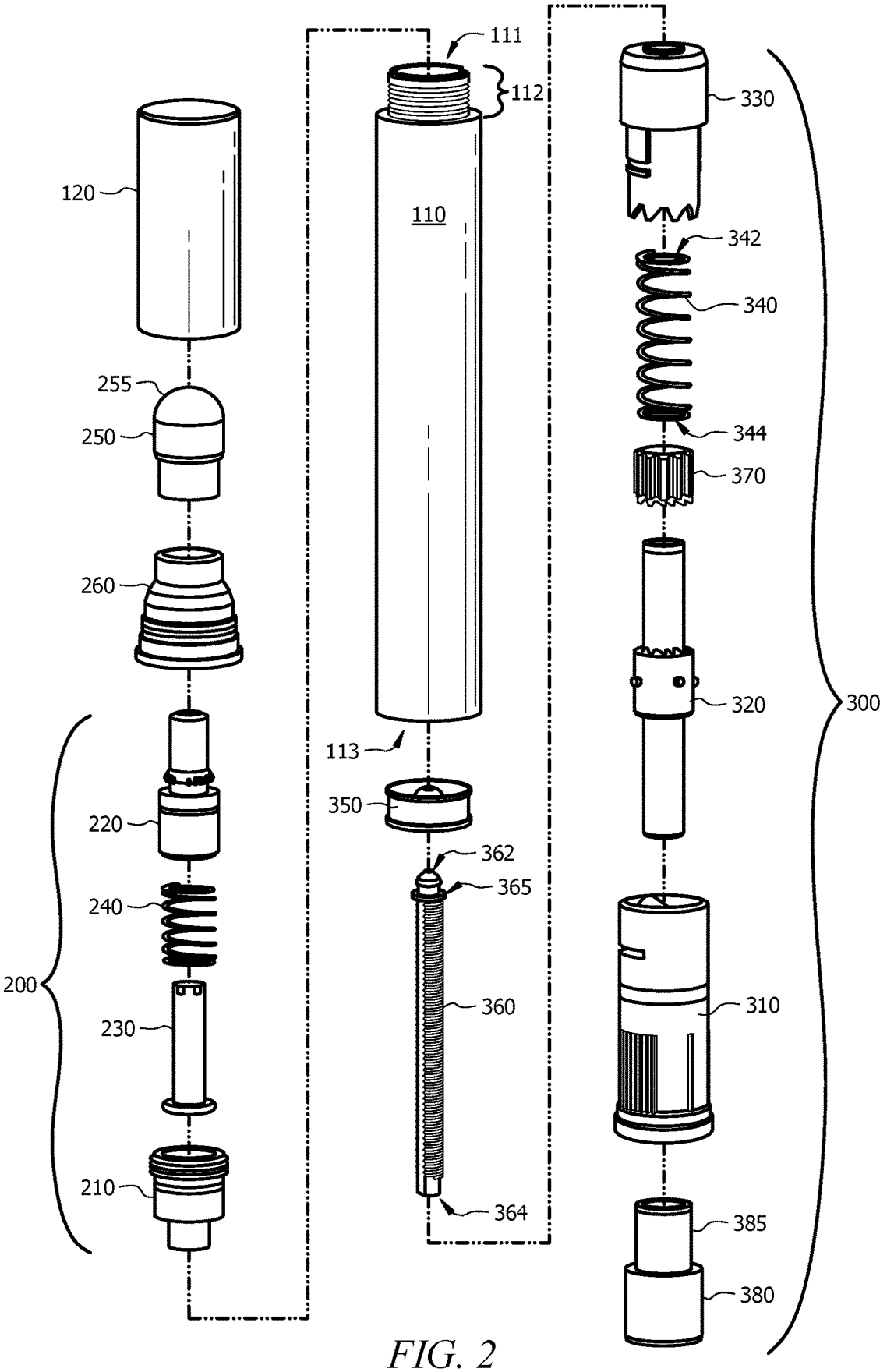
FIG. 2 includes an expanded view of the components of a liquid transfer assembly and a pump assembly of the dispenser illustrated in FIGS. 1A, 1B, and 1C.

FIG. 2 includes an expanded view of the components of the dispenser 100 introduced in FIGS. 1A, 1B, 1C and 1E. As shown in FIG. 2, a transfer assembly 200 and a pump assembly 300 are coupled to opposing ends of the body 110 of the dispenser 100 illustrated in FIGS. 1A, 1B, 1C, and 1D. More specifically, the transfer assembly 200 is coupled to section 112 of the body 110 proximal to opening 111 and the pump assembly 300 is assembled and inserted through the opposed end 113 of the body 110. The transfer assembly 200 includes an adapter 210 and an applicator base 220. In addition, as shown in FIG. 2 and FIG. 1D, which presents a cross-sectional view in the direction of Line 1D-1D of the dispenser 100 illustrated in FIG. 1A, a piston 230 and a bias member 240 are arranged within the applicator base 220 with a portion of the applicator base 220 being enclosed circumferentially by a portion of the adapter 210.

The transfer assembly 200, including the adapter 210, the applicator base 220, the piston 230 and the bias member 240, is coupled to the body 110 by the neck 260. As indicated in FIG. 2 the neck 260 is arranged with a portion including annular surface variations spaced to compliment corresponding surface variations over section 112 of the body 110. In an example embodiment, the applicator base 220 and the adapter 210 are made from a thermoplastic polymer such as polypropylene, while the piston 230 can be made from polypropylene or polyethylene. In the example embodiment, the bias member 240 is a helical spring made from coiled hardened steel. Alternatively, a spring or springs made from metal or plastic may replace the bias member 240 as desired.

In the example embodiment, the applicator 250 is made from an absorbent, sponge like, compressible material, flocked with fibers and shaped to resemble a tip of a finger. However, it should be understood that the applicator 250 may be arranged in many different shapes and sizes. Alternative applicators may include combs, brushes, pads, etc. arranged with pores or other openings in fluid communication with the applicator base 220 of the transfer assembly 200. However arranged, the applicator 250 is supported by the applicator base 220 and arranged to distribute and or apply a stored liquid in the dispenser 100 to a desired surface.

In contrast with conventional assemblies that have been criticized for requiring twenty five or more cycles of a manipulator before a stored liquid is present at the surface of an applicator, the transfer assembly 200 dramatically reduces the number of cycles of a manipulator that may be required to advance a stored liquid from the reservoir 150 to a surface 255 of the applicator 250. For a conventional pen-like manipulator mechanism an operator can hear fifty or more clicks as a result of the manipulation of the push and release mechanism before a stored liquid arrives at an applicator.

Arrangements of the transfer assembly 200 enable the transfer of stored liquid from the reservoir 150 to the surface of the applicator in less than about 15 to 20 cycles of the fluidic pressure in the reservoir. For example, it has been demonstrated that for at least one arrangement of the dispenser 100 with the transfer assembly 200 that less than about 10 cycles of the fluidic pressure in the reservoir 150 resulted in the displacement of residual air and the successful transfer of stored liquid from the reservoir 150 to the surface 255 of an applicator 250. Some tests using the transfer assembly together with a pump assembly as shown in the illustrated embodiments have shown that a stored liquid can arrive at an applicator in about 6 to 7.5 cycles of the manipulator. In these tests liquid arrived at an applicator of a previously unused dispenser in about 12 to 15 "clicks".

Figure 5A:
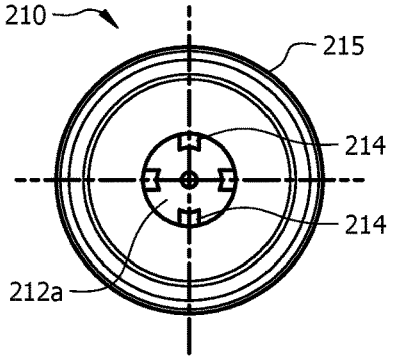
FIGS. 5A, 5B and 5C illustrate representative top, front and bottom plan views of the adapter of FIG. 2.
Figure 5B:
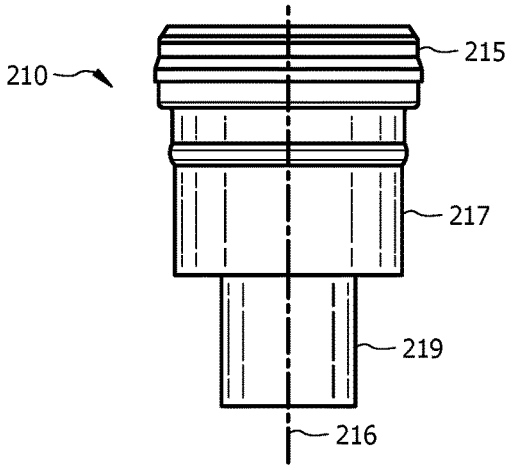
Figure 5C:
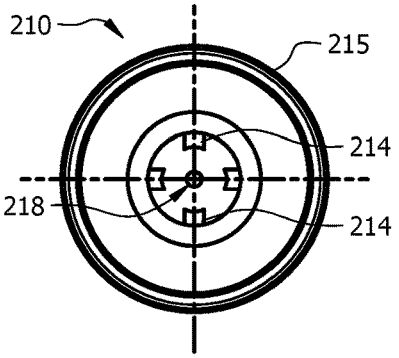
Figure 5D:
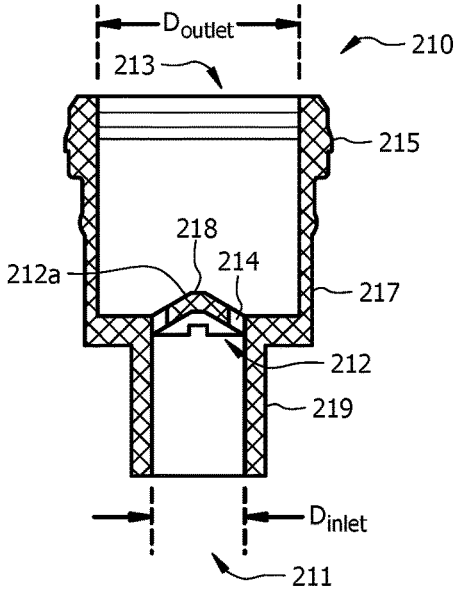
FIG. 5D is a cross-sectional view of the adapter illustrated in FIGS. 5A, 5B and 5C.
Figure 5E:
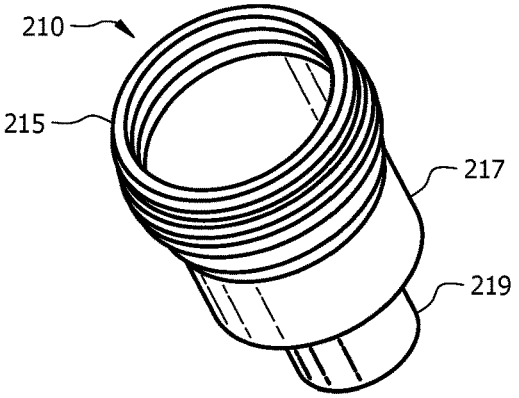
FIG. 5E is a perspective view of the adapter illustrated in FIGS. 5A, 5B and 5C.
Figure 6A:
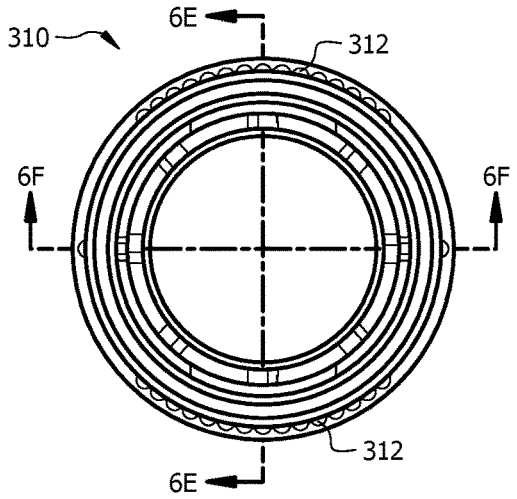
FIGS. 6A, 6B and 6C illustrate representative top, front and bottom plan views of the base of FIG. 2.
Figure 6C:
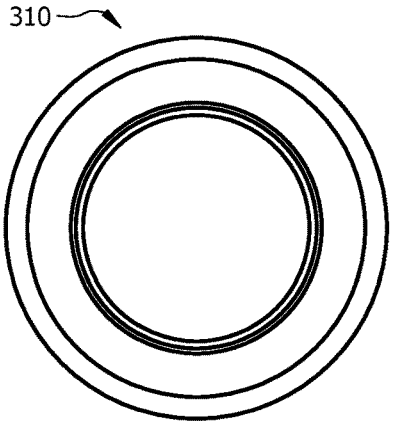
Figure 6B:
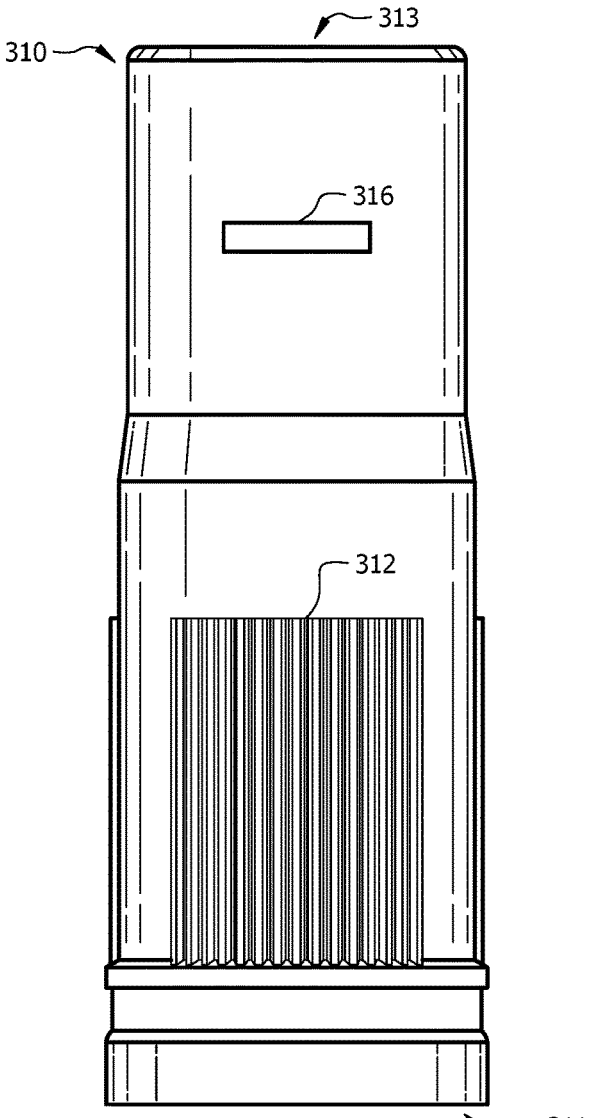
Figure 6E:
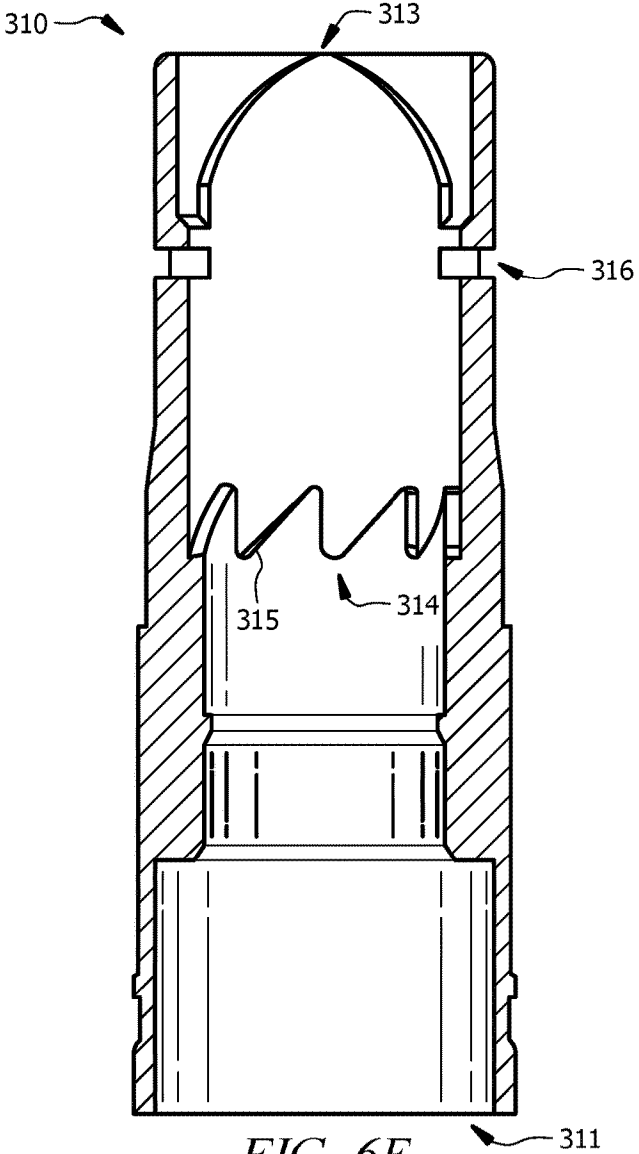
FIGS. 6E and 6F are respective cross-sectional views of the base in the direction of line 6E-6E and line 6F-6F illustrated in FIG. 6A.
Figure 6D:
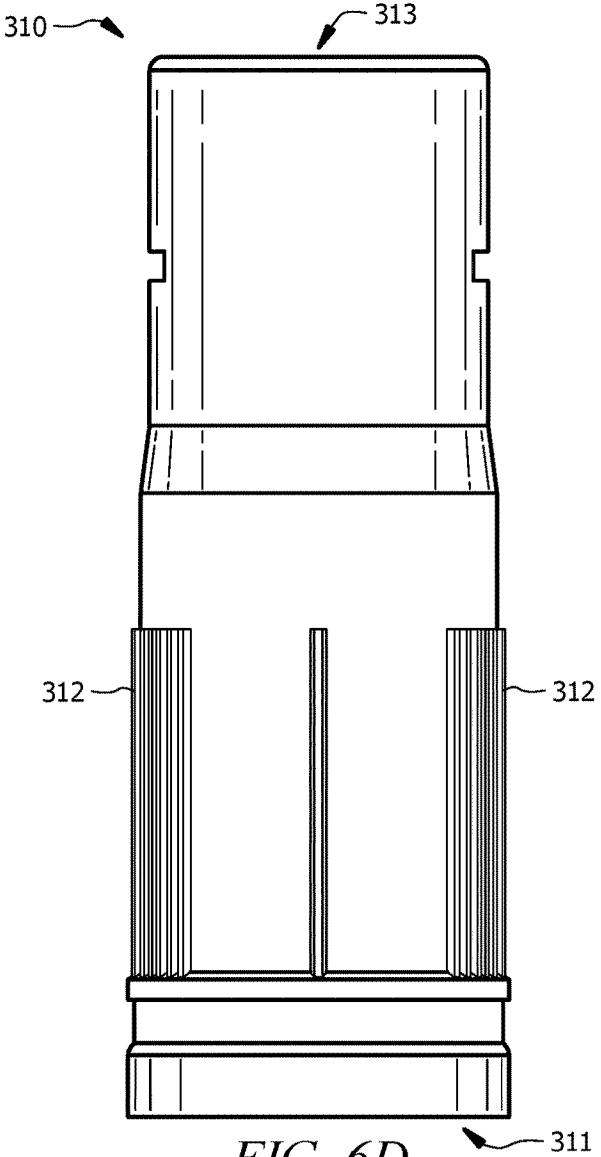
FIG. 6D illustrates a side view of the base illustrated in FIGS. 6A, 6B and 6C.
Figure 6G:
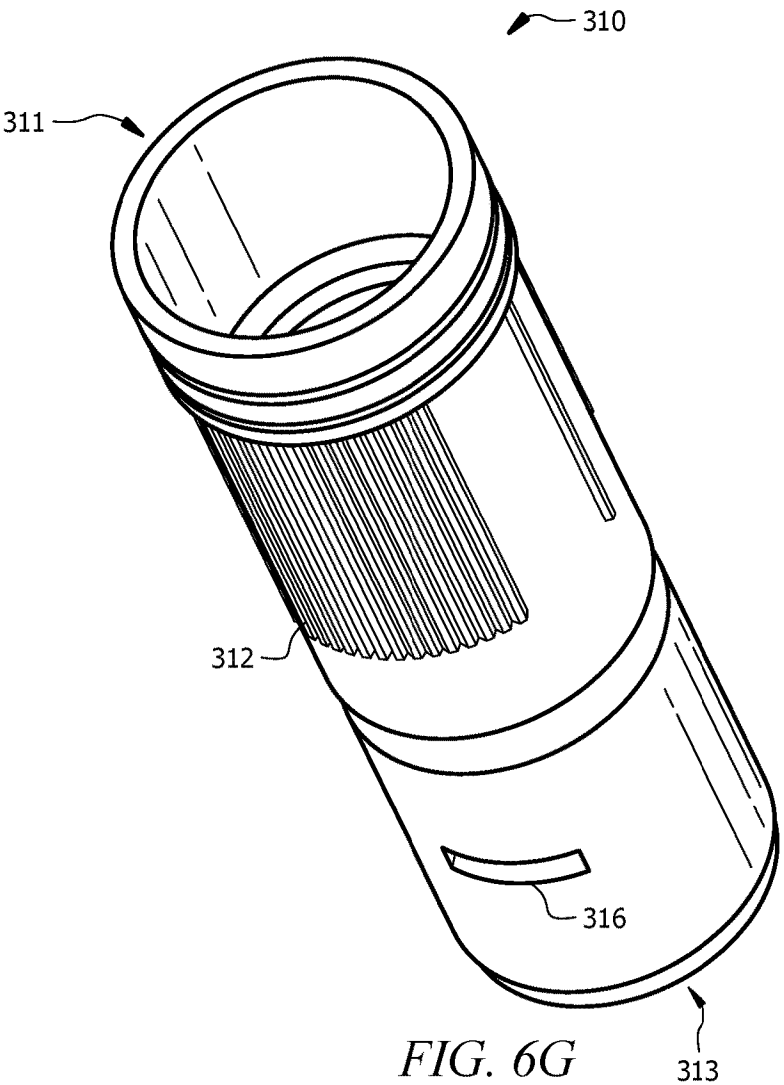
FIG. 6G is a perspective view of the base illustrated in FIGS. 6A, 6B and 6C.
Figure 6F:
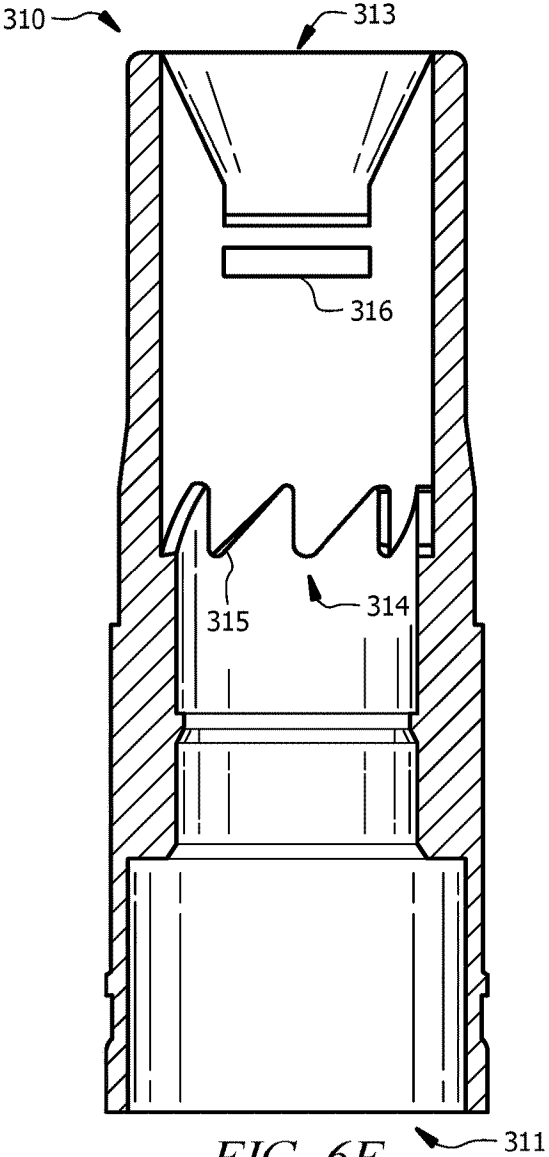

FIGS. 5A, 5B and 5C illustrate representative top, front and bottom plan views of the adapter 210 of FIG. 2. FIG. 5D is a cross-sectional view of the adapter 210 in the direction of any of the center lines illustrated in FIGS. 5A, 5B and 5C. FIG. 5E is a perspective view of the adapter 210 illustrated in FIGS. 5A, 5B and 5C. As shown in FIG. 5B, FIG. 5D and FIG. 5E, the adapter 210 includes a tubular support 217 and a tubular extension 219 arranged about a longitudinal axis 216. As illustrated in FIG. 5C and FIG. 5D, the support 217 and the extension 219 are separated by a central member 212, which is domed or cone shaped with an apex 218 proximal to the longitudinal axis 216 of the adapter 210. As illustrated in FIG. 5D, the apex 218 of the central member 212 extends in a direction toward the outlet 213 and away from the inlet 211. The central member 212 includes a seal surface 212*a* and orifices 214 that enable fluid communication from an inlet 211 to an outlet 213. In the example embodiment, four orifices 214 are distributed in 90° increments and are located along an inner surface of the extension 219. Alternative arrangements having more or less than four orifices are contemplated. Such alternative arrangements may include orifices of different sizes or even the same size unevenly distributed about the central member 212 in fluid communication with the inlet 211.

When assembled in the example embodiment of the dispenser 100, as shown in FIG. 1D, a portion of the extension 219 forming the inlet 211 of the adapter 210 extends into and enables fluid communication between the reservoir 150 and the transfer assembly 200. An inward facing surface of a wall of the support 217 and the central member 212 define a cavity arranged to closely receive a portion of the applicator base 220. A section 215 arranged about the outer circumference of the support 217 proximal to the outlet 213 of the adapter 210 provides an annular ledge or stop that contacts an end surface of the support section 112 of the body 110 in a direction that is substantially orthogonal to the longitudinal axis 216. The section 215 further provides a circumferential surface that contacts a complimentary inner surface of the neck 260 (shown in FIG.

2). In an example embodiment, the adapter 210 can be made from various plastics including polypropylene among others.

Figure 3A:
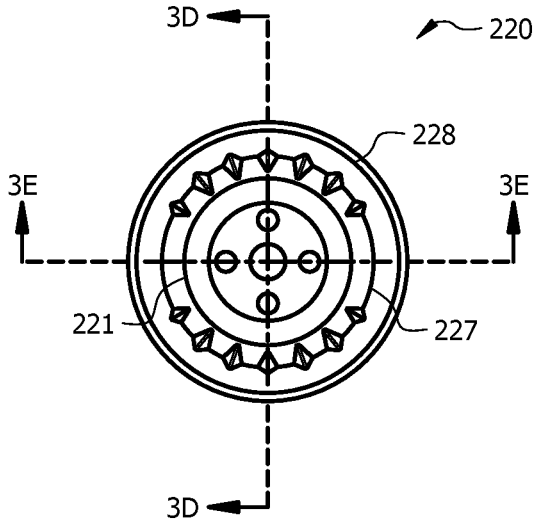
FIGS. 3A, 3B and 3C illustrate representative top, front, and bottom plan views of the applicator base of FIG. 2.
Figure 3B:
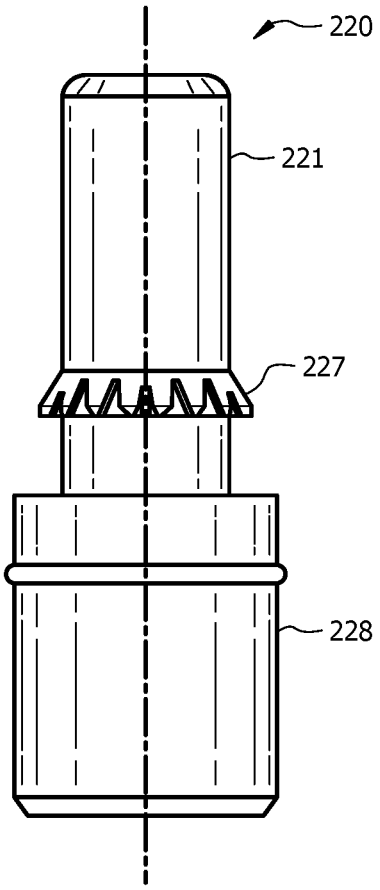
Figure 3C:
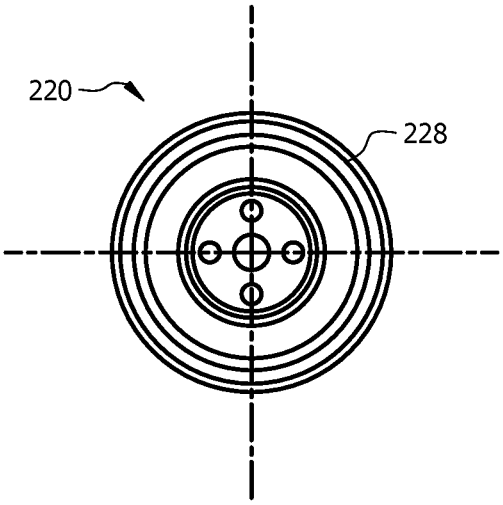
Figure 3D:
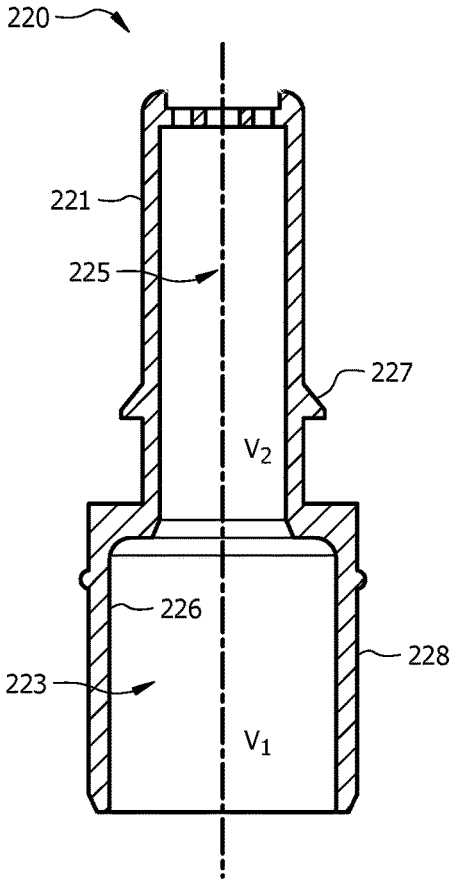
FIGS. 3D and 3E illustrate separate cross-sectional views of the applicator base in the direction of line 3D-3D and line 3E-3E, respectively, as illustrated in FIG. 3A.
Figure 3E:
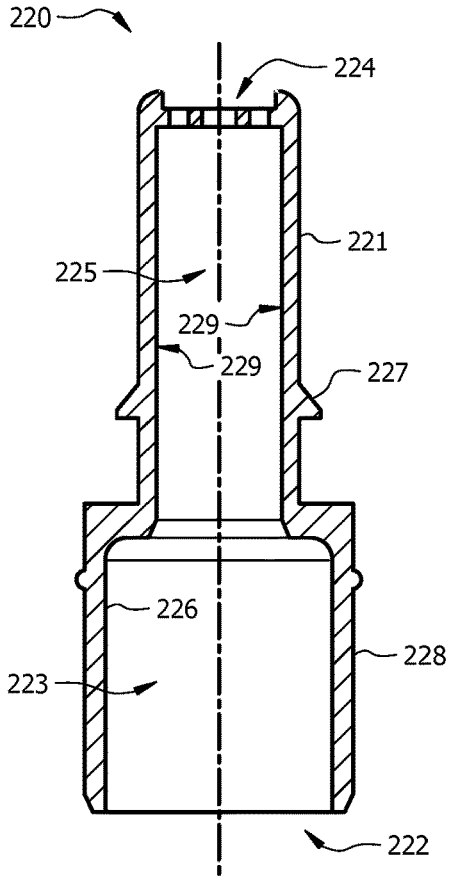
Figure 3F:
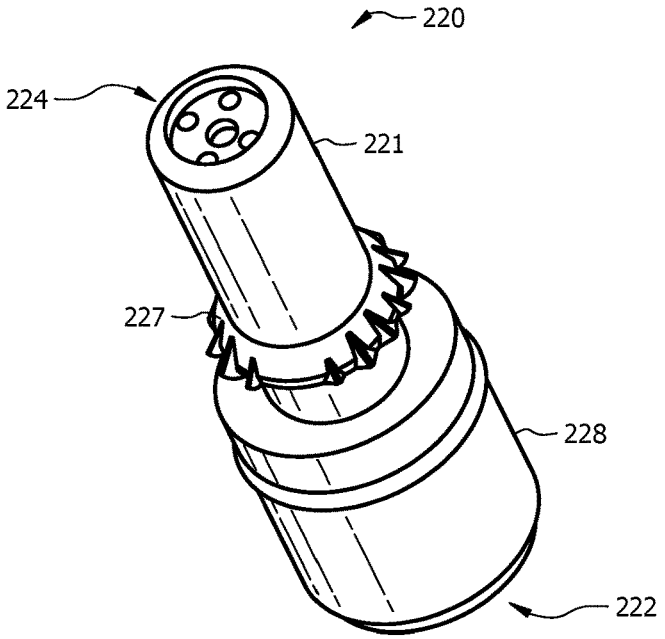
FIG. 3F is a perspective view of the applicator base illustrated in FIGS. 3A, 3B and 3C.

FIGS. 3A, 3B and 3C illustrate representative top, front, and bottom plan views of the applicator base 220 of FIG. 2. As shown in FIGS. 3A-3F, the adapter base 220 includes a guide 228 with an extension or applicator support 221 extending beyond the guide 228. The support 221 partially encloses a cavity 225 surrounded circumferentially by a surface 229. The cavity 225 is in fluid communication with an outlet 224. In the illustrated arrangement, the outlet 224 includes an array of five openings with a centrally located opening that is larger than the remaining openings which are evenly distributed about the center of the outlet 224 and proximal to a diameter of the cavity 225.

Alternative outlet arrangements are contemplated. These alternative arrangements may include more or less outlets with the same sizes or different sizes. These alternative outlet arrangements may include openings that are evenly spaced from each other or unevenly spaced from each other and/or arrangements where some openings are evenly spaced from each other in a first row and remaining openings have a different spatial relationship between adjacent openings as may be desired.

The cavity 225 defines a volume $V_2$. The volume defined within the cavity 225 may be adjusted by adjusting the length of the transition region and/or the length and the inner diameter of the applicator support 221. Such adjustments may necessitate corresponding adjustments in the applicator 250, the neck 260 and/or the piston 230.

The guide 228 includes an external surface adjacent to an extension or support 211 of the adapter 210 that provides an annular stop for an open end of the applicator 250. The guide 228 further includes a cylindrical wall that contacts central member 212 of the adapter 210. The cylindrical wall of the guide 228 is in close contact with an inward facing surface of the support 217 of the adapter 210 and extends just beyond the outlet 213 of the adapter 210. The guide 228 partially encloses a cavity 223 surrounded circumferentially by a surface 226. The guide 228 is open at an inlet 222 that is in fluid communication with the outlet 224. A reducing wall or partition separates the cavity 223 from the cavity 225. A bevelled surface is arranged in the reducing wall. The cavity 223 defines a volume $V_1$ that houses or encloses the bias member 240, the head portion 232 of the piston 230 and a portion of the tubular member 234 also of the piston 230. The volume defined within the cavity 223 may be adjusted by adjusting the length of the curved portion of the transition region and/or the length and the inner diameter of the applicator guide 228. Such adjustments may necessitate corresponding adjustments in the bias member 240 and the head portion 232 of the piston 230.

The extension or support 221 includes an annular holder 227 arranged along an outer surface. The annular holder 227 slopes away from the outer surface of the support 221 toward the guide 228. An outer edge of the holder 227 is irregularly shaped to grasp and hold the applicator 250 (shown in FIGS. 1D, 1E and FIG. 2). The extension or support 221 further includes a collar at the distal end proximate to the outlet 224. The collar separates an interior surface of the applicator 250 from the openings in the outlet 224.

In the illustrated embodiment, both the annular holder 227 and the annular rib are continuous. In alternative embodiments, one or both of these elements may be arranged with one or more discontinuities along the outer surfaces of the support 221 or the guide 228, respectively. In these alternative embodiments, when more than one discontinuity is present along one or both of the annular holder 227 and the annular rib, such discontinuities may be regularly spaced or irregularly spaced about the perimeter surfaces of the support 221 or the guide 228, respectively.

Figure 4A:
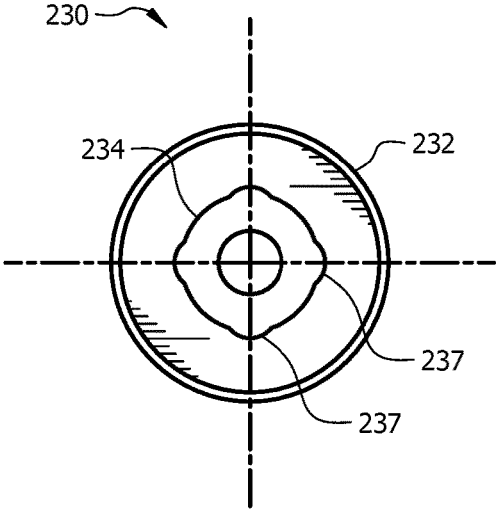
FIGS. 4A, 4B and 4C illustrate representative top, front and bottom plan views of the piston of FIG. 2.
Figure 4B:
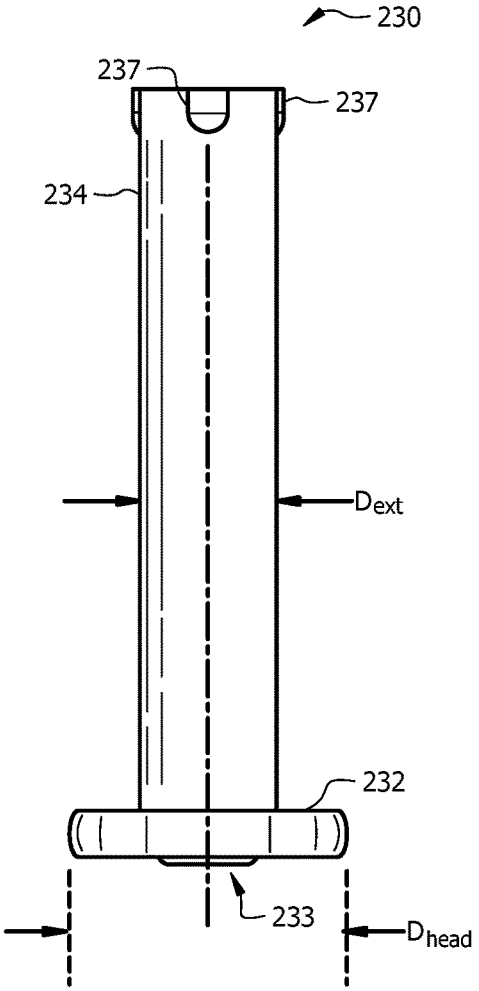
Figure 4C:
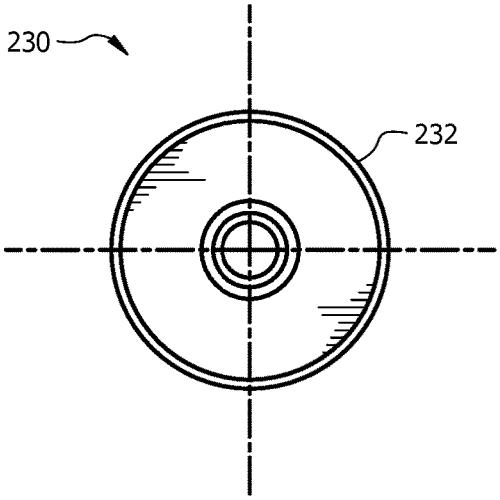
Figure 4D:
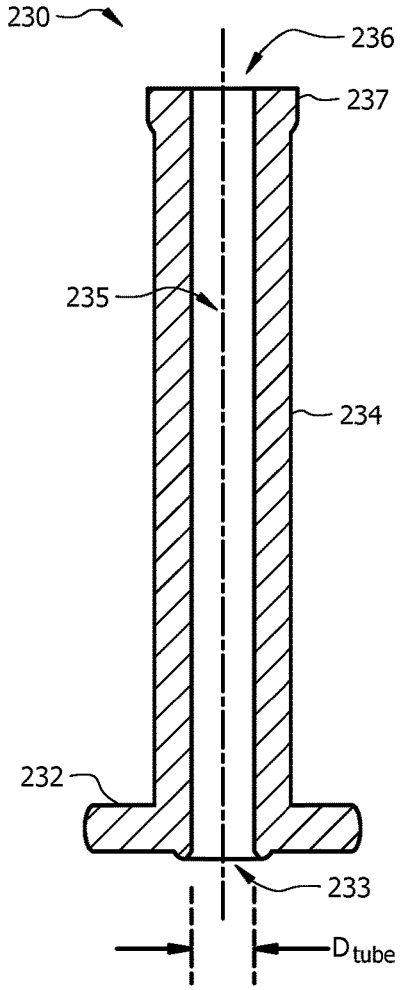
FIG. 4D is a cross-sectional view of the piston illustrated in FIGS. 4A, 4B and 4C.
Figure 4E:
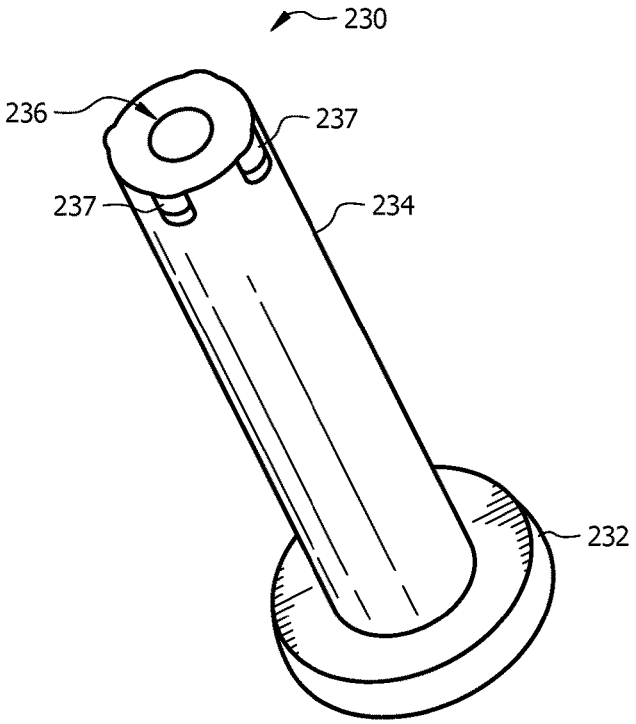
FIG. 4E is a perspective view of the piston illustrated in FIGS. 4A, 4B and 4C.

FIGS. 4A, 4B and 4C illustrate representative top, front, and bottom plan views of the piston 230 of FIG. 2. FIG. 4D illustrates a cross-section of the piston 230 in the direction of any of the center lines of FIG. 4A, FIG. 4B and FIG. 4C. FIG. 4E is a perspective view of the piston 230 of FIG. 2. The piston 230 can be made from various plastics including polypropylene and polyethylene among others.

As shown in FIGS. 4A-4E, the piston 230 includes a head portion 232 at a first end of the piston 230 with a tubular member 234 extending from an opposed surface of the head portion 232. In this example, the head portion 232 of the piston 230 forms an opening 233 that enables fluid communication through passage or cavity 235 of the tubular member 234. As illustrated in FIG. 4D, the head portion 232 of the piston 230 is arranged with an annular surface proximal to the opening 233 that is shaped to contact the sealing surface 212*a* of the central member 212. The shape of the annular surface is complimentary to the shape of the sealing surface 212*a* to provide a larger contact area than would otherwise be present if the wall of the cavity 235 were to directly interface with the face of the head portion 232.

As further shown in FIG. 4D, the cavity 235 extends through the entirety of the piston 230 and has a diameter $D_{tube}$. In this example embodiment, the tubular member 234 of the piston 230 has an external diameter $D_{ext}$ (see FIG. 4B) that is less than a diameter of the head $D_{head}$ of the piston 230 and that is received in the cavity 225 of the applicator base 220. In addition, the diameter $D_{head}$ of the head portion 232 of the piston 230 is in contact with the surface 226 partially defining the cavity 223 of the applicator base 220.

In the example embodiment as shown in FIG. 1D, the bias member 240 is located around tubular member 234. One end of the bias member 240 is in contact with a surface of the head portion 232 of the piston 230 adjacent to the intersection of the head portion 232 and the tubular member 234, while the opposed end of the bias member 240 contacts the reducing wall or partition of the guide 228 of the adapter base 220.

As shown in FIG. 4A, FIG. 4B, FIG. 4D and FIG. 4E, appendages 237 are arranged along the tubular member 234 of the piston 230 proximal to an end 236 of the piston 230. The end 236 is opposed to the head portion 232 of the piston 230. In the illustrated embodiment, there are a total of four appendages 237. In alternative embodiments, other numbers of appendages 237 including two, three or five or more may be deployed in accordance with their respective arcuate lengths and distributions about the tubular member 234 as may be desired. The appendages 237 reduce the contact area between the tubular member 234 and the complimentary surface 229 of the interior of the applicator base 220, thereby enabling longitudinal displacement of the piston 230 along the axis 105 of the body 110 when the fluidic pressure in the reservoir 150 exceeds a bias force applied against the head portion 232 of the piston 230.

As further shown in FIG. 1D, the support 217 guides and closely receives the head portion 232 of the piston 230. A surface along the outer circumference of the head portion 232 prevents the passage of significant amounts of air and liquid into the cavity 223. However, when the pressure against the head portion 232 of the piston overcomes the bias force applied by the bias member 240, the piston 230 is displaced toward the adapter 250. This displacement permits residual air, if any, and a portion of the liquid to enter the passage or cavity 235 via the opening 233 in the head portion 232 of the piston 230. When the liquid advances and the pressure on the reservoir side of the head portion 232 is no longer greater than the bias force exerted by the bias member 240, the opening 233 in the head portion 232 of the piston 230 is pressed against the sealing surface 212*a* of the central member 212 of the adapter 210.

Figure 12A:
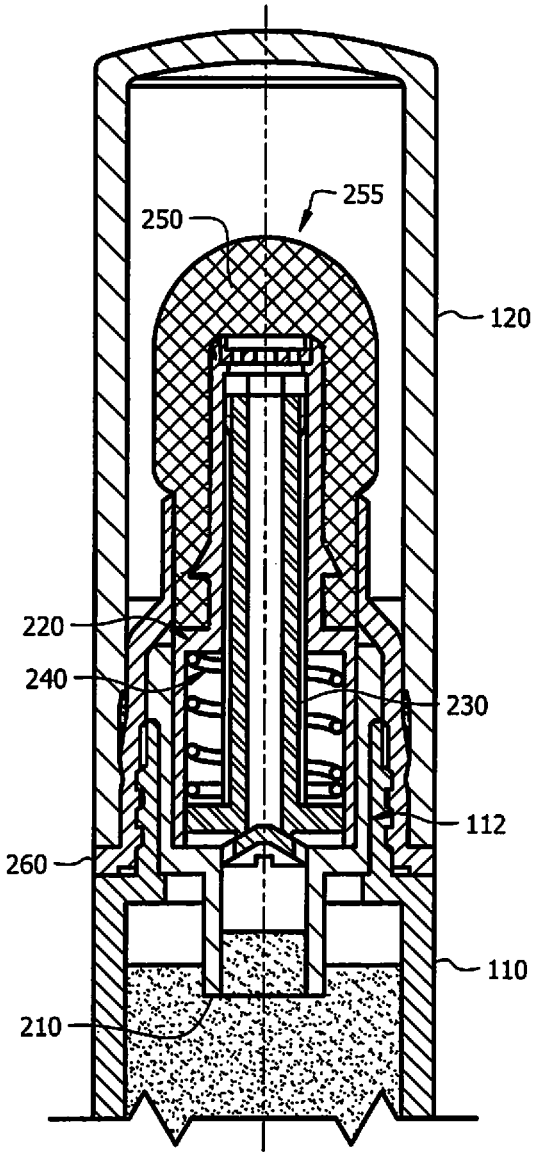
FIGS. 12A, 12B, 12C, 12D and 12E illustrate movement of a stored liquid through the transfer assembly of FIG. 2.
Figure 12B:
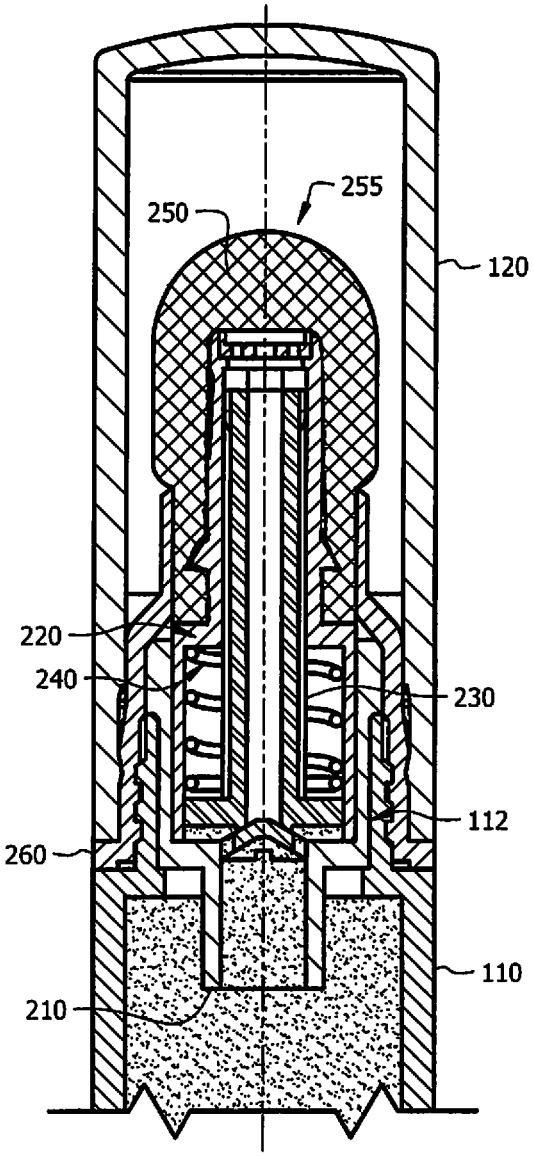
Figure 12C:
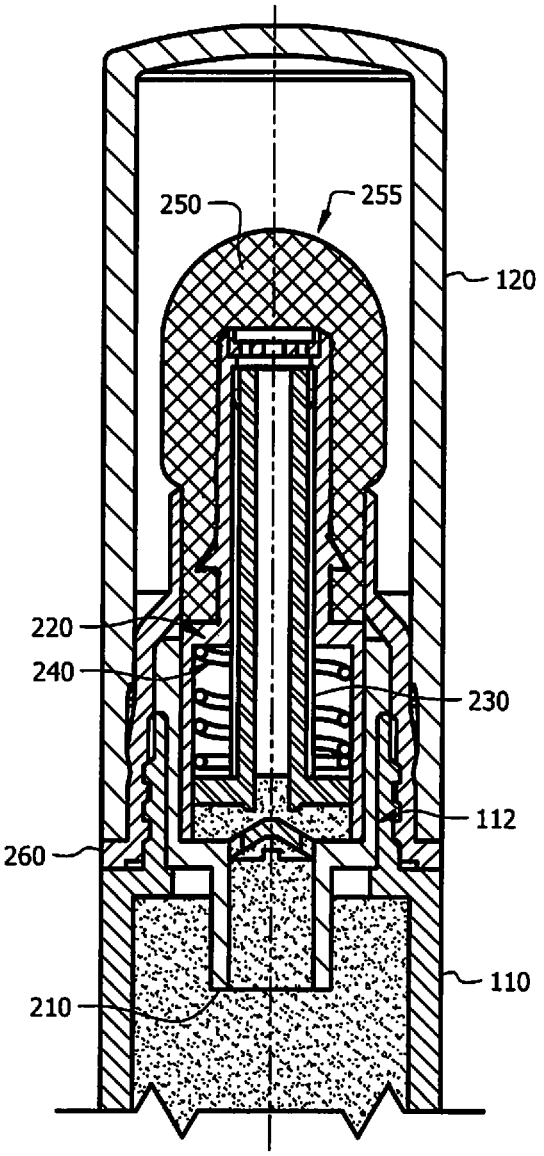
Figure 12D:
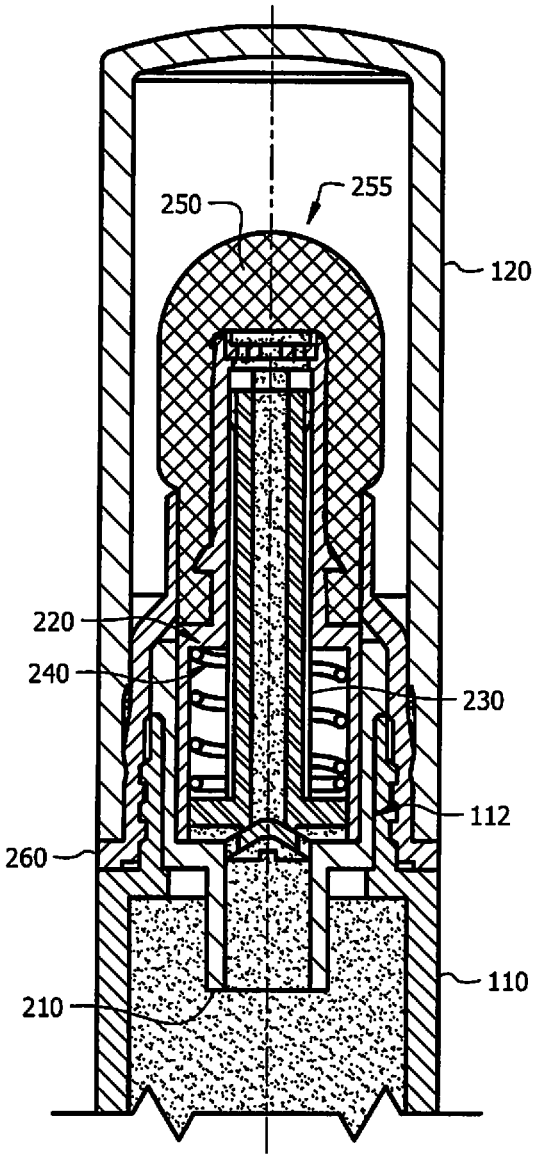
Figure 12E:
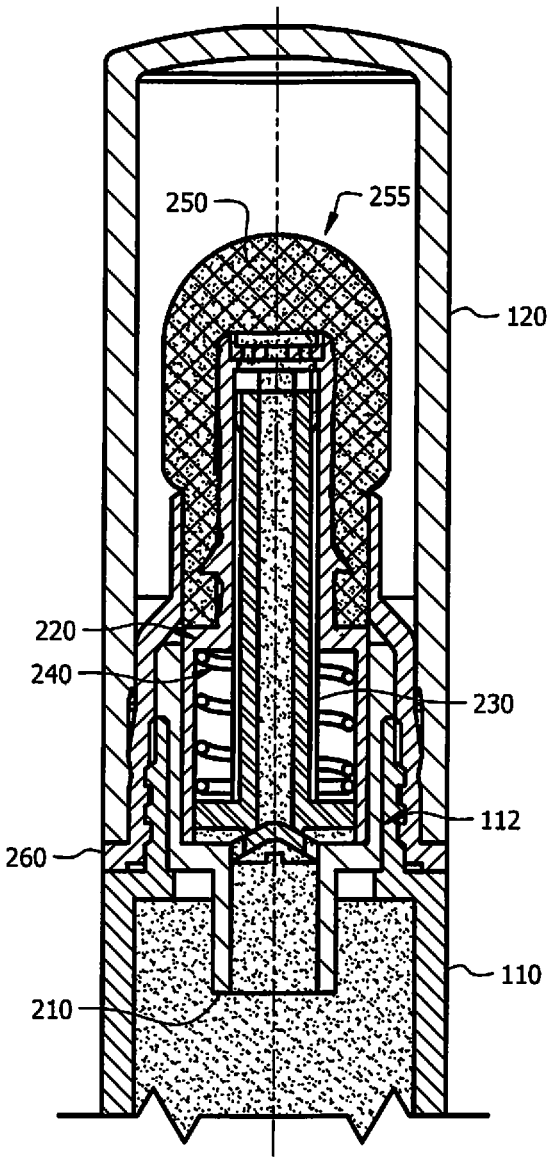

At rest, as shown in FIG. 12C, liquid present in the distal portion of the passage or cavity 235 remains separate from the liquid in the reservoir 150. As further illustrated in FIG. 12D, subsequent cycles of the pushbutton 380 repeat the process of displacing the piston 230 and advancing a portion of the stored liquid into the passage or cavity 235 of the tubular member 234 of the piston 230. As previously described, the illustrated and described transfer assembly 200 efficiently transfers a stored liquid from the reservoir 150 in the body 110 to a surface 255 of the applicator 250, as illustrated in FIG. 12E, in less than about ten cycles of the pump assembly 300. Even fewer cycles of the pump assembly 300 may be required when the reservoir 150 is nearly entirely filled.

Those skilled in the art will recognize that one of the transfer assembly 200 and the pump assembly 300 will be connected to or placed within the body 110 of the dispenser 100, respectively, before a liquid may be introduced in the reservoir 150 of the body 110. When the pump assembly 300 is integrated in the body 110, the reservoir 150 may be filled from end 111. Alternatively, when the transfer assembly 200 is coupled to the body 110, the reservoir 150 may be filled from the base end 113.

As illustrated in FIG. 1D and FIG. 2, the transfer assembly 200 may be assembled by placing an open end of applicator 250 over the cylindrical support 221 of the applicator base 220 until the applicator 250 abuts the annular stop provided at the transition wall of the guide 228. Such placement will place the inner surface of the applicator 250 in contact with the holder 227 of the applicator base 210. The holder 227 has an annular external surface arranged to engage or hold the applicator 250 on the portion of the applicator base 220.

Next, the bias member 240 can be placed over the tubular member 234 of the piston 230 and the tubular member 234 can be placed in the cavity 225 of the applicator base 220. Thereafter, the guide 228 of the applicator base 220 can be placed into the support 217 until the wall of the guide 228 contacts the central member 212 of the adapter 210. As a result of this placement, the bias member 240 will be under compression and the head portion 232 of the piston 230 will be in contact with the sealing surface 212*a* of the central member 212 of the adapter 210. More specifically, the surface that defines the opening 233 of the head portion 232 piston 230 will engage the sealing surface 212*a* of the central member 212. The components of the transfer assembly 200 are coupled to the support section 112 of the body 110 by placing the applicator 250 through the smaller of the opposed openings of the neck 260 and pressing the complimentary engaging surfaces of the neck 260 over the respective surfaces of the support section 112 of the body 110 and the section 215 of the adapter 210, which extends beyond the support section 112.

The pump assembly 300 supports and advances a wiper 350 coupled to a threaded rod 360. The threaded rod 360 has a first end 362 shaped to engage a complimentary surface or surfaces of the wiper 350 and an opposed end 364 which passes through the coupler 330 and a significant portion of the driver 320 when the pump assembly 300 is initially assembled. As shown in FIG. 2, the threaded rod 360 is arranged with an external thread interrupted by opposed flat surfaces that permit the portion of the threaded rod below an annular stop 365 to pass through a corresponding slot in the driver 320. In an example embodiment, the wiper 350 is made from polyethylene or a compliant and compressible material that is stable in the presence of a stored liquid present in the reservoir 150. In this embodiment, and the threaded rod 360 can be made from a thermoplastic such as polyoxymethylene (POM), also known as acetal, polyacetal and polyformaldehyde, which can be used in precision parts which require high stiffness, low friction and excellent dimensional stability or a terpolymer synthesized of carbon monoxide (CO), thylene and propylene commonly referred to as POK.

As shown in FIG. 1D, the wiper 350 separates a stored liquid enclosed within reservoir 150 defined by an inward facing surface 115 of the body 110 of the dispenser 100. In an example embodiment, the stored liquid is a cosmetic product. In alternative embodiments, the stored liquid could be paint, stain, sealer, etc. In operation, the slot in the driver 320 contacts the opposed flat surfaces of the threaded rod 360 and rotation of the driver 320 and the threaded rod 360 advances the wiper 350 into the reservoir 150 in the direction of the transfer assembly 200.

The pump assembly 300 includes the base 310, the pushbutton 380 coupled to the base 310, as well as, the driver 320 and a coupler 330 with a bias member 340 applying a bias force from the coupler 330 to the driver 320. In an alternative or optional embodiment, a fixed sleeve 370 is further included and is arranged in engagement with the coupler 330.

As indicated in FIG. 6A through FIG. 6G, the base 310 is a hollow cylinder with appendages 312 along an outer surface. Opposed slots 316 extend through a wall of the base 310. The base 310 defines an opening 313 at a first end proximal to the slots 316 and an opposed opening 311 proximal to the appendages 312. As further shown in the cross-sectional views illustrated in FIG. 6E and FIG. 6F, the wall of the base 310 has an annular recess 314 along an inner surface. The annular recess 314 ends at an irregular surface 315, which in the illustrated embodiment includes eight evenly distributed locations where a slope of the irregular surface is discontinuous. Accordingly, points and valleys are evenly distributed about the circumference of the base 310 with adjacent points located at 45° intervals and adjacent valleys located at respective 45° intervals. The slope of transitions from a point to an adjacent valley is not the same as the slope of transitions from a valley to an adjacent point. As previously described, the base 310 may be made from various plastics known for mechanical strength such as ABS.

Figure 7A:
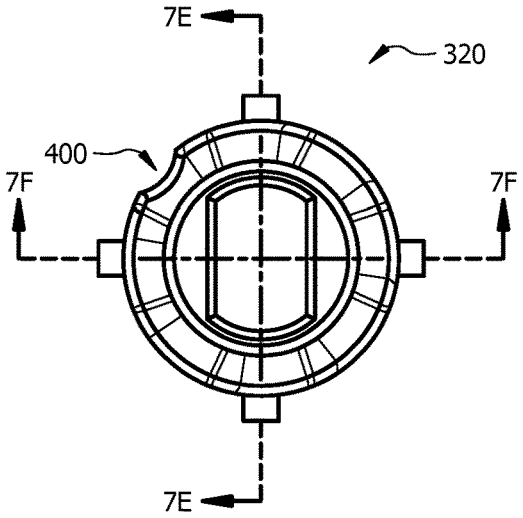
FIGS. 7A, 7B and 7C illustrate representative top, front and bottom plan views of the driver of FIG. 2.
Figure 7B:
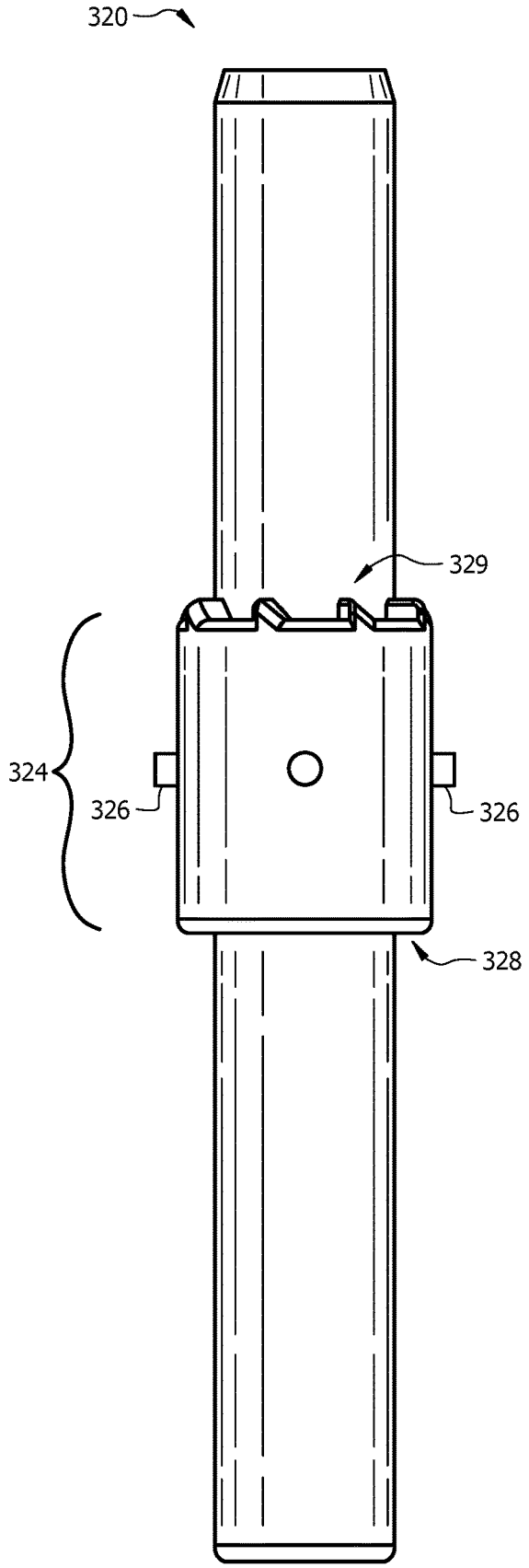
Figure 7C:
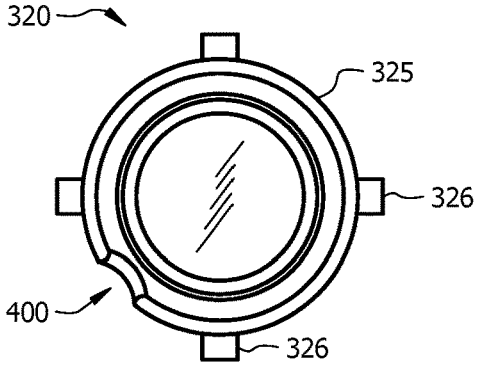
Figure 7D:
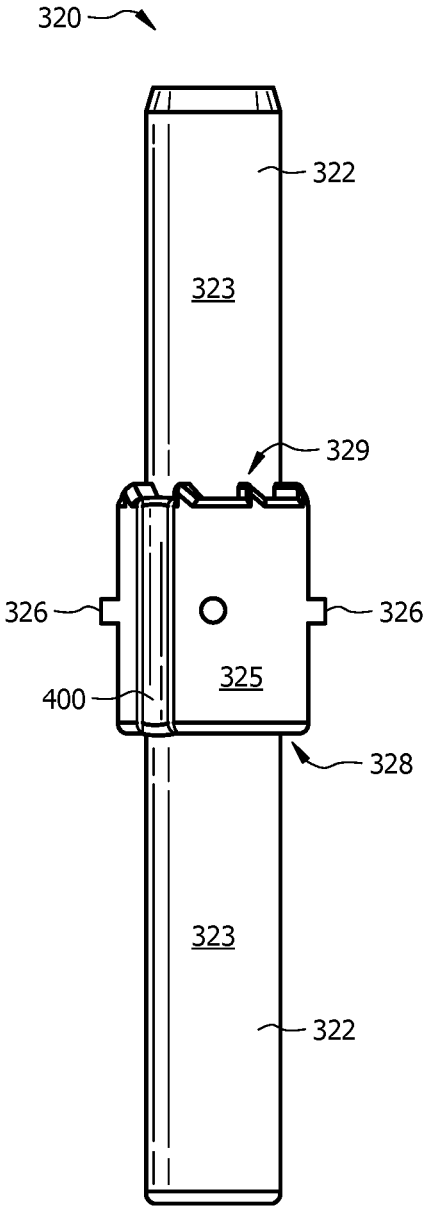
FIG. 7D illustrates a side view of the driver illustrated in FIGS. 7A, 7B and 7C.
Figure 7E:
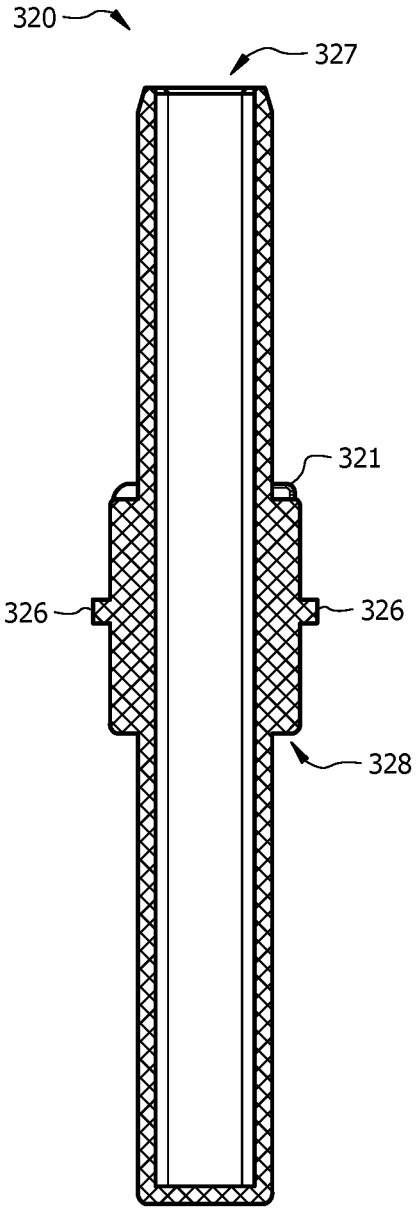
FIGS. 7E and 7F are respective cross-sectional views of the driver in the direction of line 7E-7E and line 7F-7F illustrated in FIG. 7A.
Figure 7F:
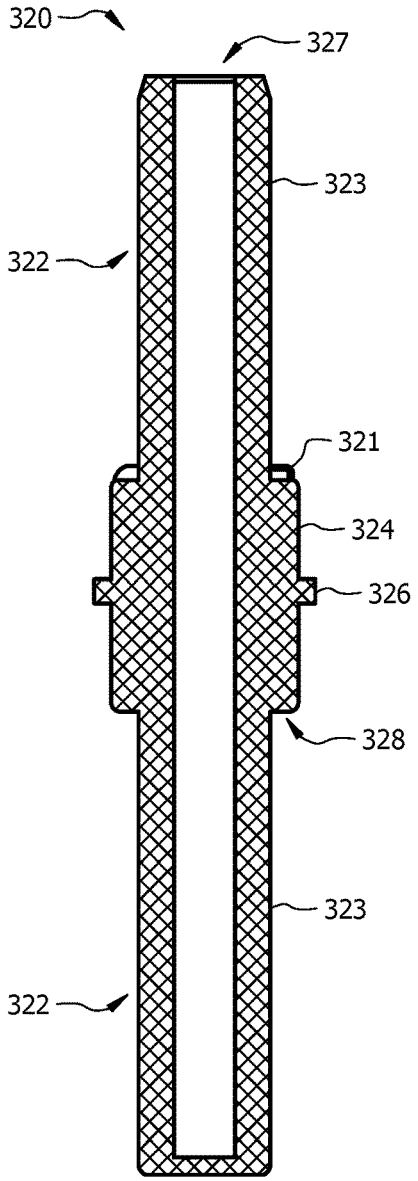
Figure 7G:
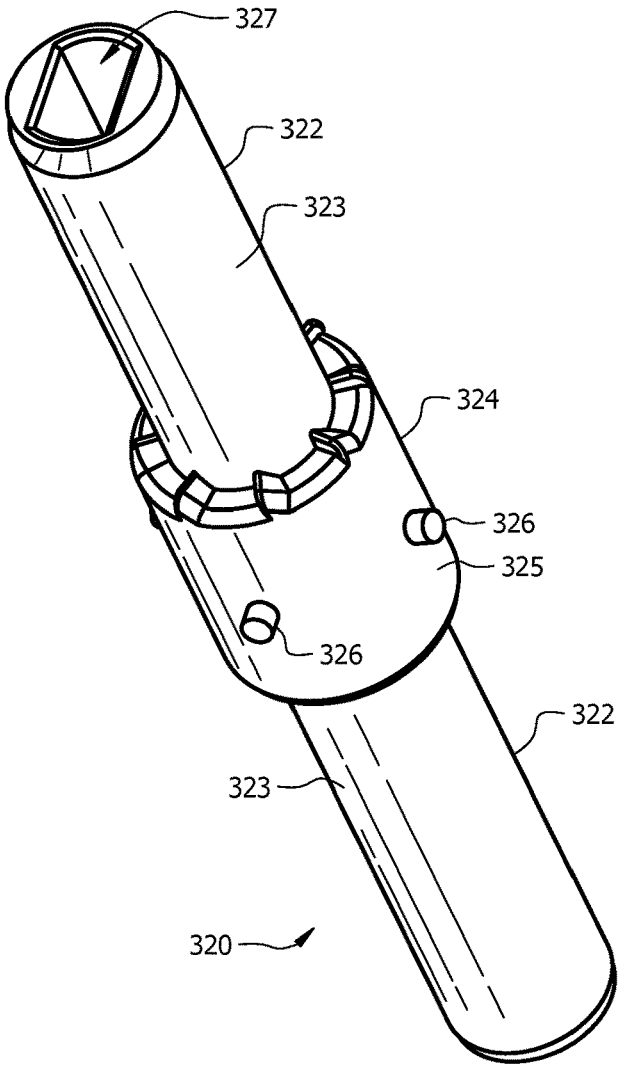
FIG. 7G is a perspective view of the driver illustrated in FIGS. 7A, 7B and 7C.

As illustrated in FIG. 7A through FIG. 7G, the driver 320 is an elongate element with an open end or slot 327 opposed to a closed end. As illustrated in FIG. 7A, FIG. 7E and FIG. 7G, the slot 327 is defined by opposed surfaces that are parallel to each other. As shown in FIG. 7B, FIG. 7D, FIG. 7E, FIG. 7F and FIG. 7G, the driver 320 is arranged with an annular section or member 324 located along a tubular member 322. The tubular member 322 has a surface 323 from which the annular member 324 extends radially away from a central axis of the driver 320. The annular member 324 has a respective surface 325 with pins 326 extending radially therefrom. The annular member 324 further includes an annular surface 328 and an opposed cam surface 329 that are substantially parallel to each other and to respective surfaces at the closed end and the open end of the driver 320. As shown in FIG. 7A, FIG. 7B, FIG. 7D and FIG. 7G, the cam surface 329 provides a set of eight highpoints or appendages 321 which extend toward the open end of the driver 320 from the annular member 324. In the illustrated arrangement, the appendages 321 are evenly distributed and shaped like right triangles with a first surface that is substantially parallel to a central axis of the driver 320 and a second surface that returns more gradually to the cam surface 329.

In the illustrated embodiment, the driver 320 has four pins 326 which are evenly distributed about the circumference of the surface 325 of the annular member 324. The pins 326 are located at about a midpoint of the surface 325. In addition, the annular member 324 is located at about a midpoint along the length of the driver 320. As further illustrated in FIG. 7A, FIG. 7C and FIG. 7D, the surface 325 of the annular member 324 defines a gate 400 that extends from the annular surface 328 to the cam surface 329. As described, the driver 320 can be made from POM or POK.

As indicated in FIG. 8A through FIG. 8F, the coupler 330 is a hollow cylinder that is partially closed at a head end 332 and open at an opposed end 334. The head end 332 includes an opening 338, the interior surface of which is threaded to compliment or engage the exterior threads arranged along the threaded rod 360. The head end 332 includes a bevelled surface along a leading edge proximal to the opening 338. The bevelled edge guides the pump assembly 300 through the interior of the body 110.

The coupler 330 further includes an irregular annular surface 336 at the opposed end 334. The irregular annular surface 336 provides a set of appendages which extend away from the head end 332 of the coupler 330. In the illustrated arrangement, the appendages are evenly distributed with respective surfaces that transition from a valley closest to the head end 332 having a first slope and respective surfaces that transition from a point furthest from the head end 332 toward the head end 332 of the coupler 330 having a second slope that is different from the first slope.

Figure 8A:
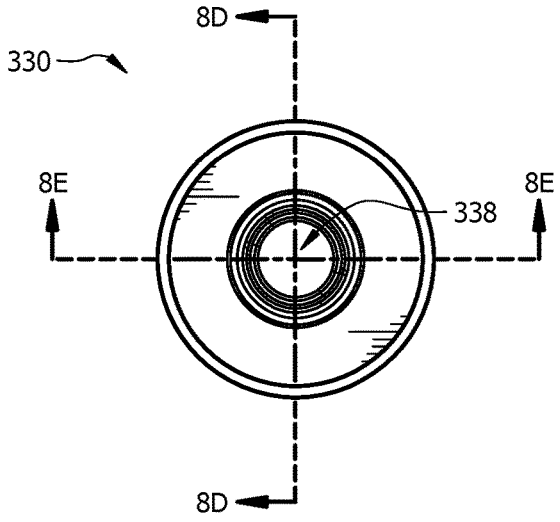
FIGS. 8A, 8B and 8C illustrate representative top, front and bottom plan views of the coupler of FIG. 2.
Figure 8B:
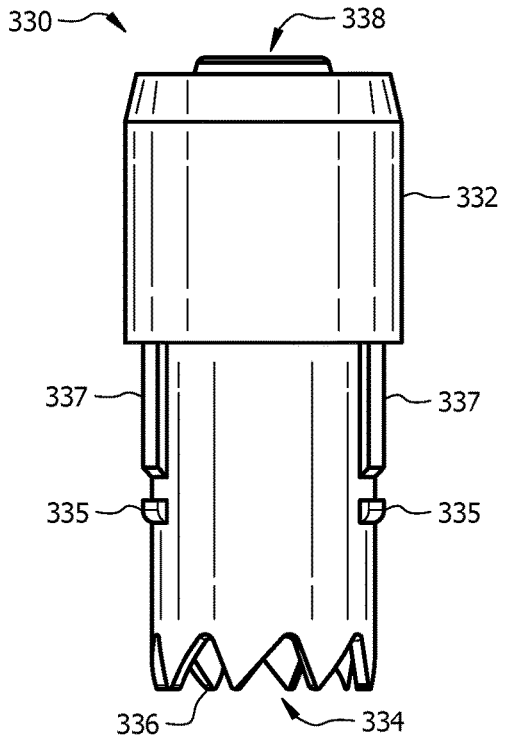
Figure 8C:
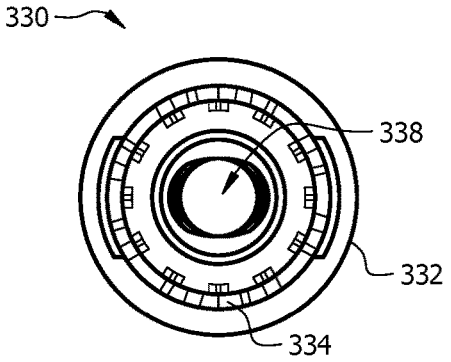
Figure 8D:
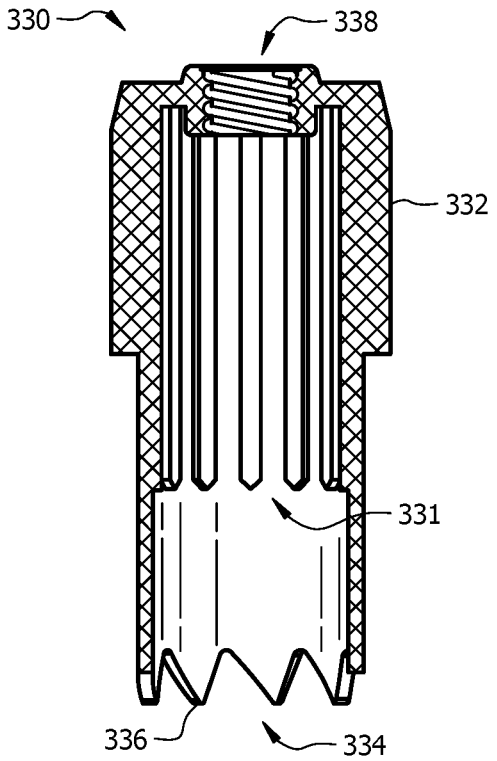
FIGS. 8D and 8E are respective cross-sectional views of the coupler in the direction of line 8D-8D and line 8E-8E illustrated in FIG. 8A.
Figure 8E:
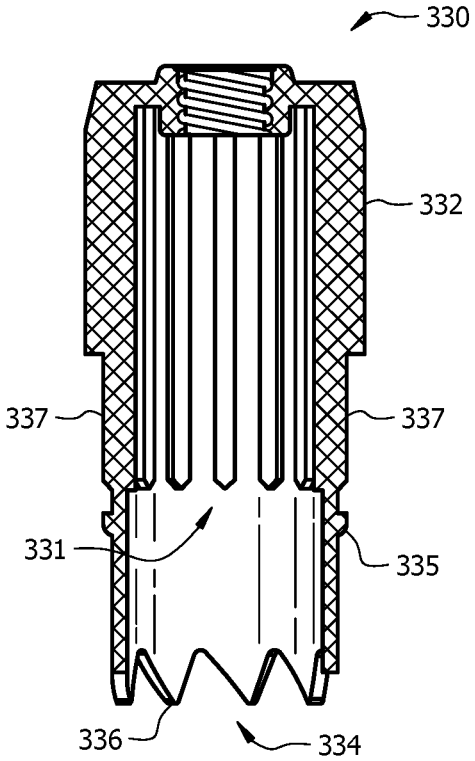
Figure 8F:
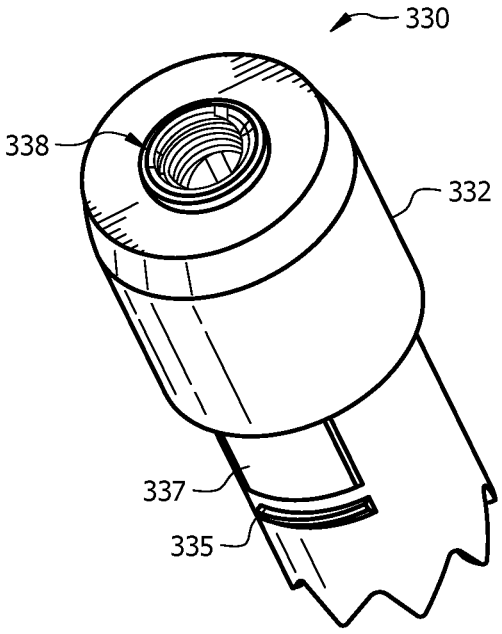
FIG. 8F is a perspective view of the coupler illustrated in FIGS. 8A, 8B and 8C.

In addition, the coupler 330 is arranged with ribs 335 and elongate ribs 337 that extend from an outer surface the head end 332, as well as a set of radial appendages 331 evenly arranged about an interior surface of the coupler 330. The ribs 335 are opposed to each other and arranged to engage the slots 316 in the base 310. The elongate ribs 337 are opposed to each other, located between the ribs 335 and a head portion of the coupler 330 and arranged to engage complimentary interior surfaces of the base 310. The radial appendages 331 are parallel to a central axis of the coupler 330 and extend from just below the partially closed end to just above the ribs 335. The radial appendages 331 have opposed surfaces that are substantially orthogonal to the interior surface of the coupler 330 with an intersecting surface between the opposed surfaces. As shown in FIG. 8D and FIG. 8E, the radial appendages 331 are arranged with a pointed end proximal to a midpoint of the coupler 330.

An embodiment of the pump assembly 300 absent the optional sleeve 370 may be assembled in many different sequences. The following describes an example order or sequence of steps that may be followed to assemble the pump assembly 300. First, the wiper 350 may be coupled to the threaded rod 360 at a first end 362. Next, the opposed end 364 of the threaded rod 360 can be introduced in the opening 338 of the coupler 330 where the threaded rod 360 and wiper 350 can be rotated in a clockwise manner until the annular stop 365 abuts a surface of the coupler 330 about the opening 338. The bias member 340 can be placed over the partially open end of the tubular member 322 of the driver 320 and the combination of the driver 320 and the bias member 340 can be slid over the threaded rod 360. The opposed or closed end of the driver 320 may be inserted into end 313 of the base 310 and one of the base 310 or the coupler 330 rotated relative to the other until the elongate ribs 337 align with the complimentary surfaces in the base 310. Once so aligned, the base 310 and the coupler 330 may be pressed together until ribs 335 of the coupler 330 engage the slots 316 in the base 310. Such arrangement coupled with the bias force applied by the bias member 340 will place the pins 326 in contact with the surface 315 along the annular recess 314 of the base 310. Next, the member 385 of the pushbutton 380 may be pressed into the end 311 of the base 310 until it engages the complimentary surfaces of the base 310.

Once the pump assembly 300' is assembled, the pump assembly 300' may be inserted into end 113 of the body 110 and pressed into the body 110 until an end surface of the base 310 is flush with an end surface of the body 110.

FIGS. 10A, 10B, 10C, 10D, 10E and 10F illustrate respective positions of the pins 326 of the driver 320 of FIG. 2 as they traverse a path 390 between the irregular annular recess 314 of the base 310 and the irregular annular surface 336 of the coupler 330.

In this example embodiment of the pump assembly 300', the pins 326 are located between a sloped portion of the annular surface 334 of the coupler 330 and a sloped surface 315 of the irregular annular recess 314 of the base 310. For example, the pins 326 are shown schematically in a starting position in the detail illustrated in FIG. 10A. The starting position is defined as the dispenser 100 at rest with the bias member 340 applying a force against the annular member 324 of the driver 320. As a result of the bias force, the pins 326 of the driver 320 are located at respective low points of the annular recess 314 in the base 310.

Figure 10A:
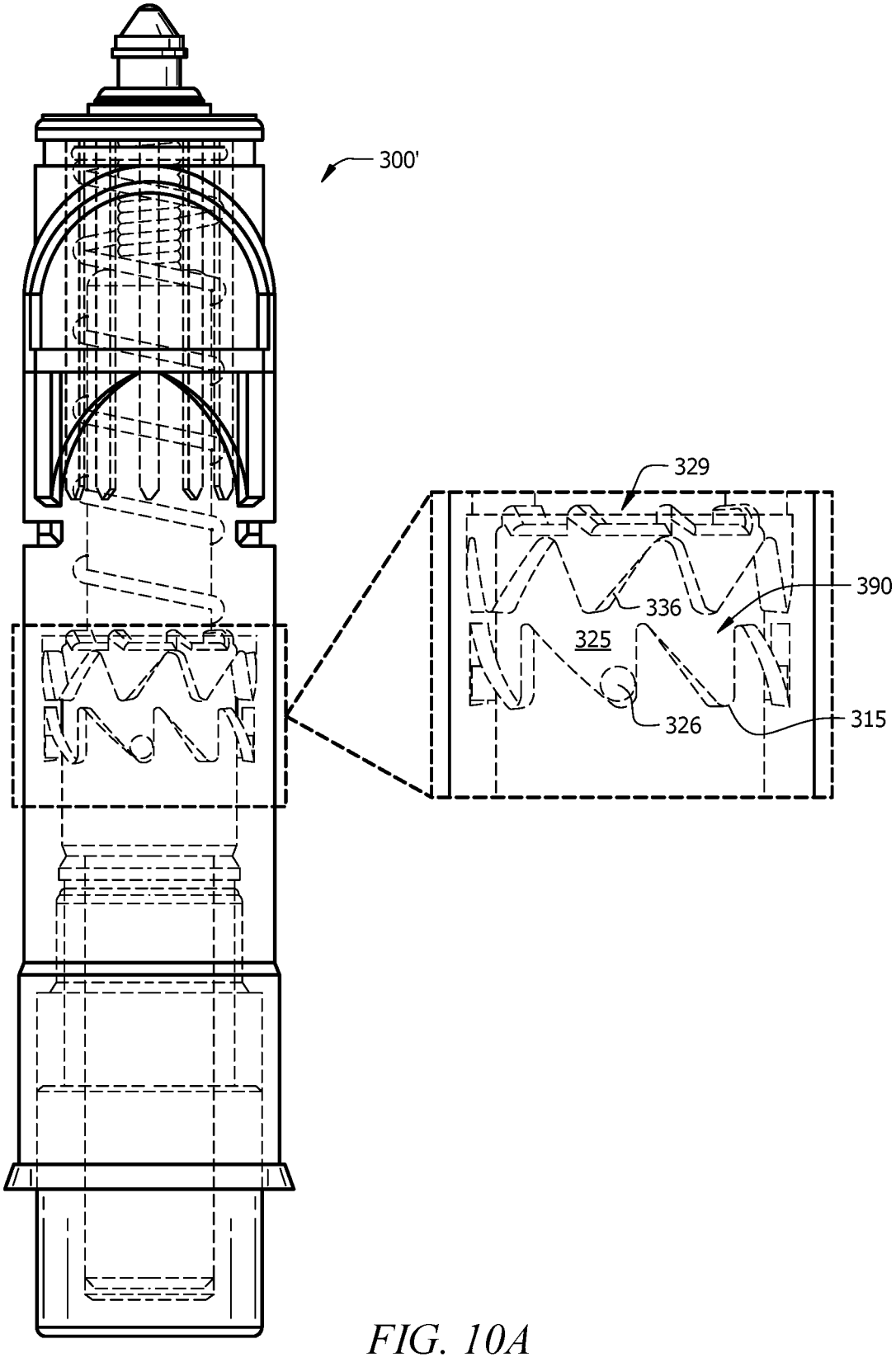
FIGS. 10A, 10B, 10C, 10D, 10E and 10F illustrate respective positions of the pins of the driver of FIG. 2 as they traverse a path between the irregular annular recess of the base and the irregular annular surface of the coupler.
Figure 10B:
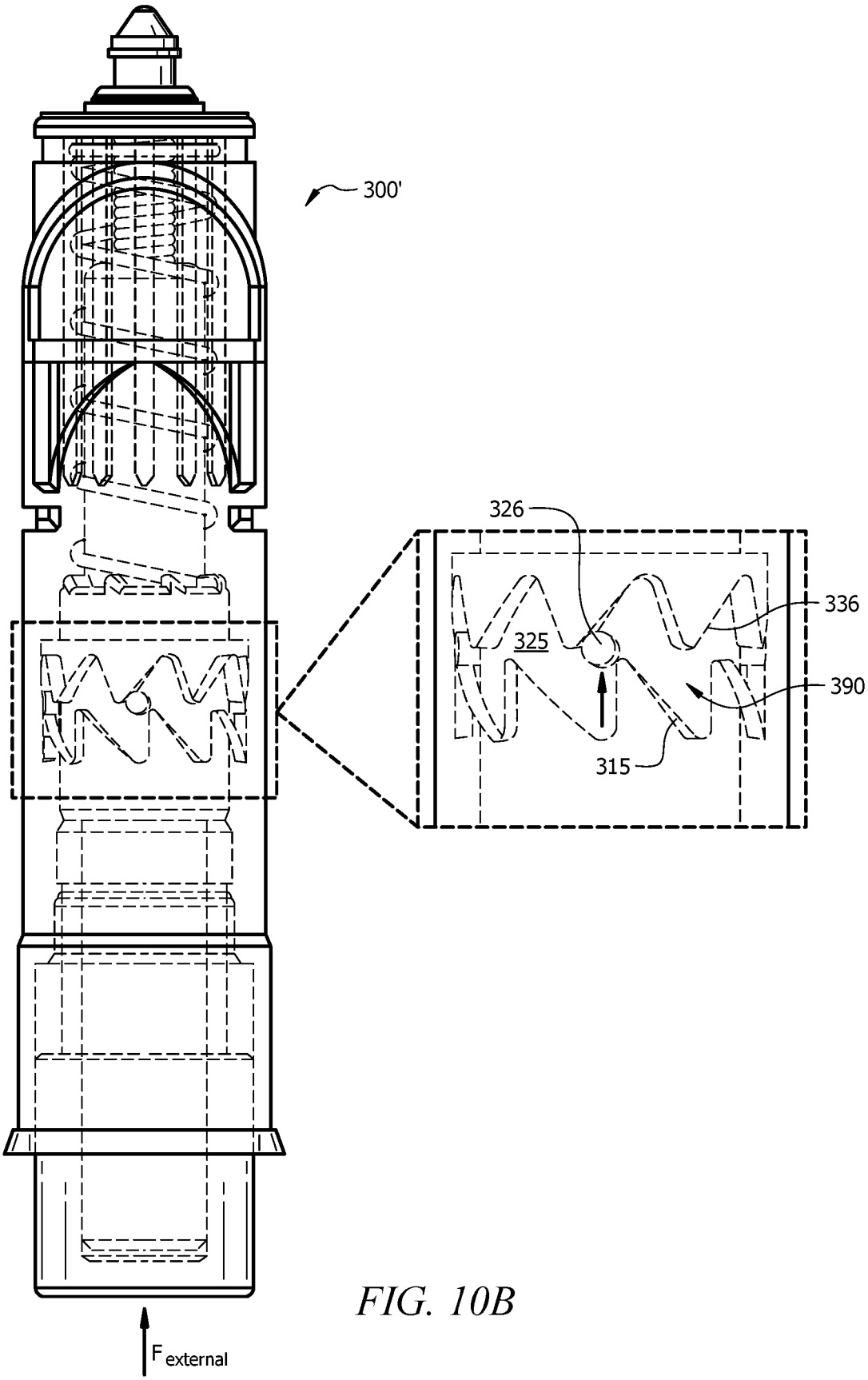
Figure 10C:
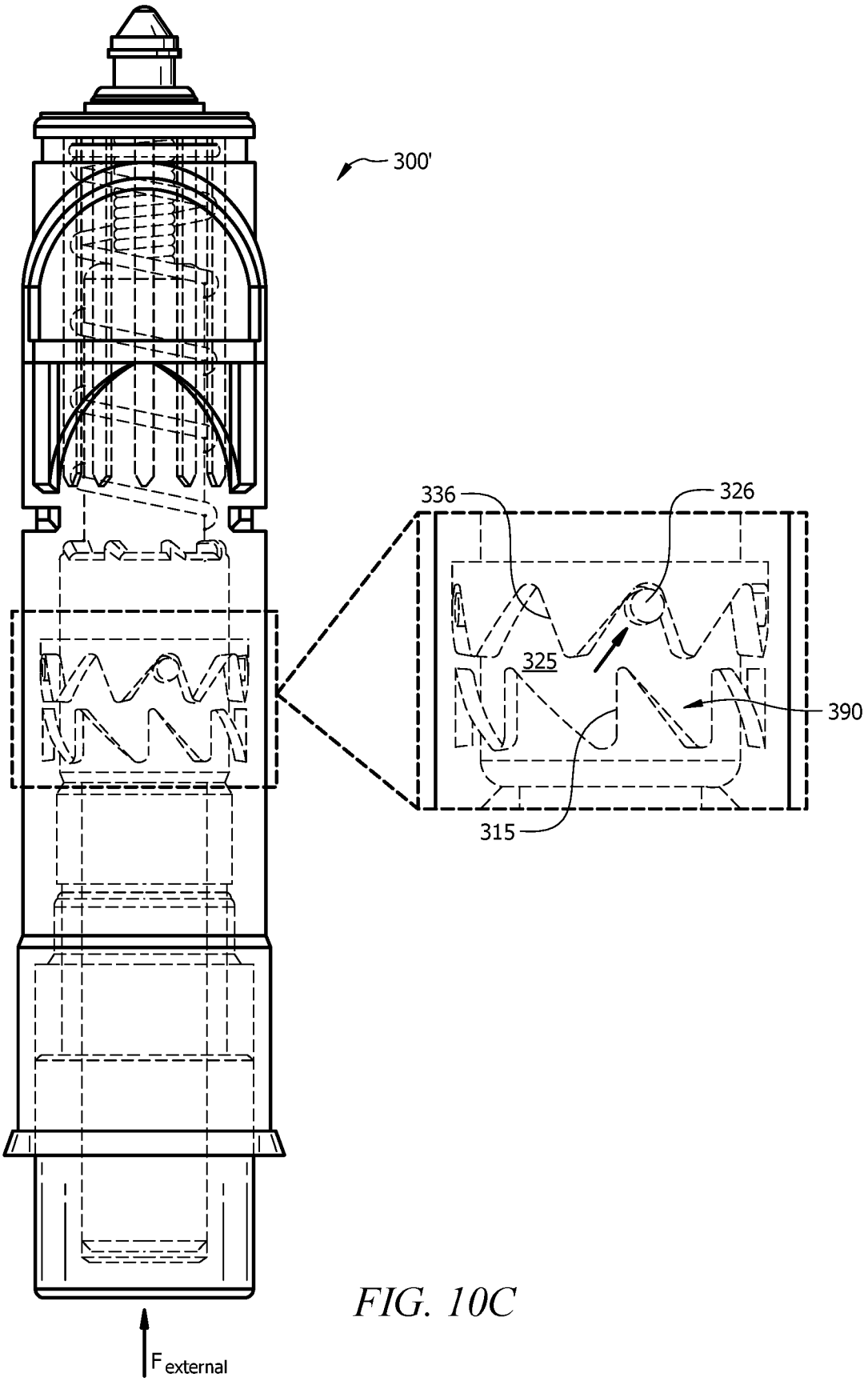

As a result of a longitudinal force (e.g., $F_{external}$) applied to the pushbutton 380 of the dispenser 100 that exceeds the bias force exerted by the bias member 340, the bias member 340 compresses and the pins 326 are displaced in a direction parallel to the longitudinal axis 105 of the dispenser 100 toward a first intermediate position of the pins 326 as illustrated in FIG. 10B. Once the pins 326 contact the sloped portion of the annular surface 336 of the coupler 330, the driver 320 starts to rotate anti-clockwise as the pushbutton 380 is further depressed until the pins 326 reach the second intermediate position as illustrated in FIG. 10C. The coupler 330 and the base 310 remain stationary within the body 310 while the driver 320 rotates advancing the threaded rod 360 and the wiper 350 into the reservoir 150. Such wiper advancement is a function of the rotation in degrees divided by 360° multiplied by the pitch of the threaded opening 338 of the coupler 330.

Figure 10D:
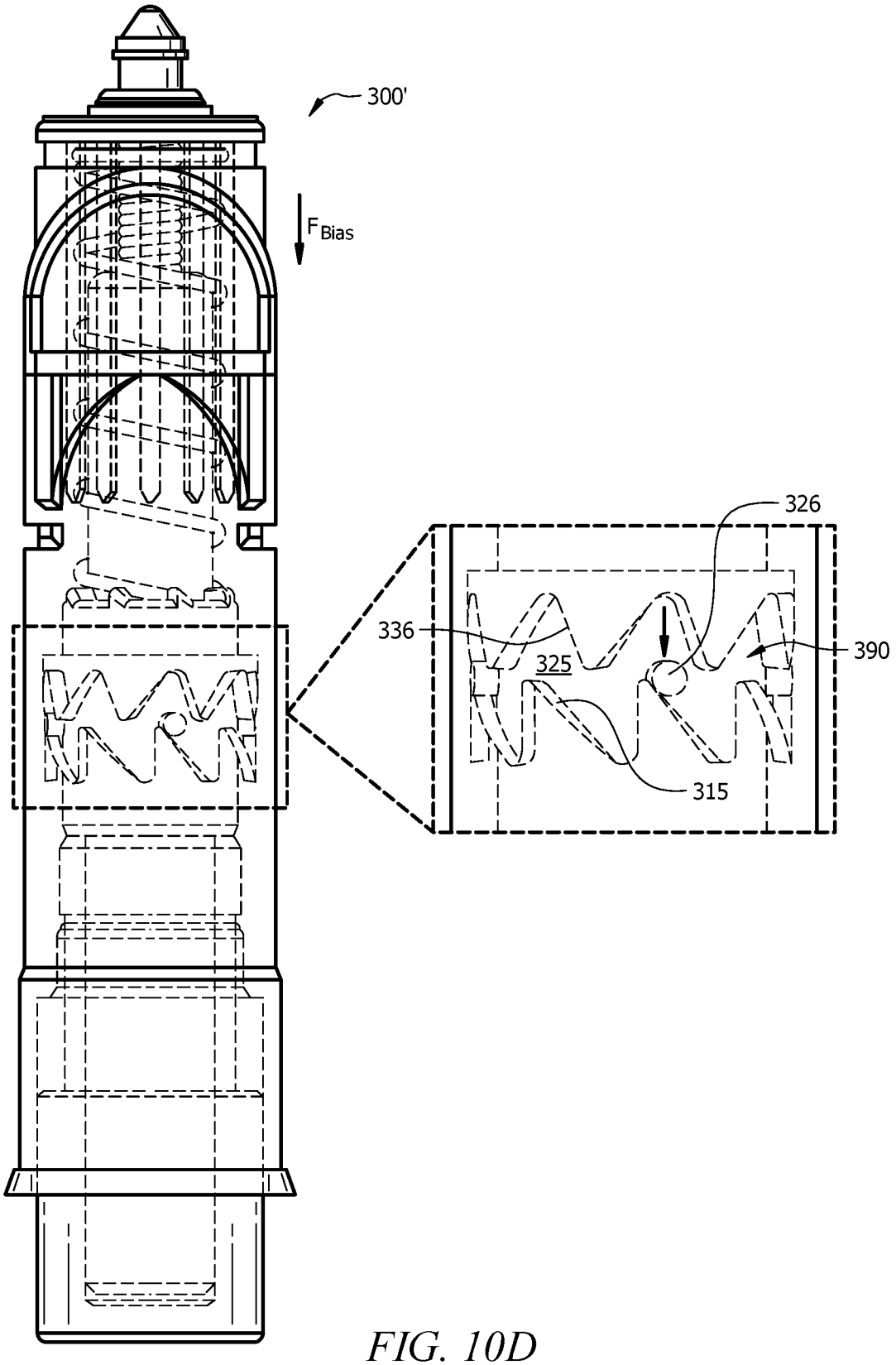
Figure 10E:
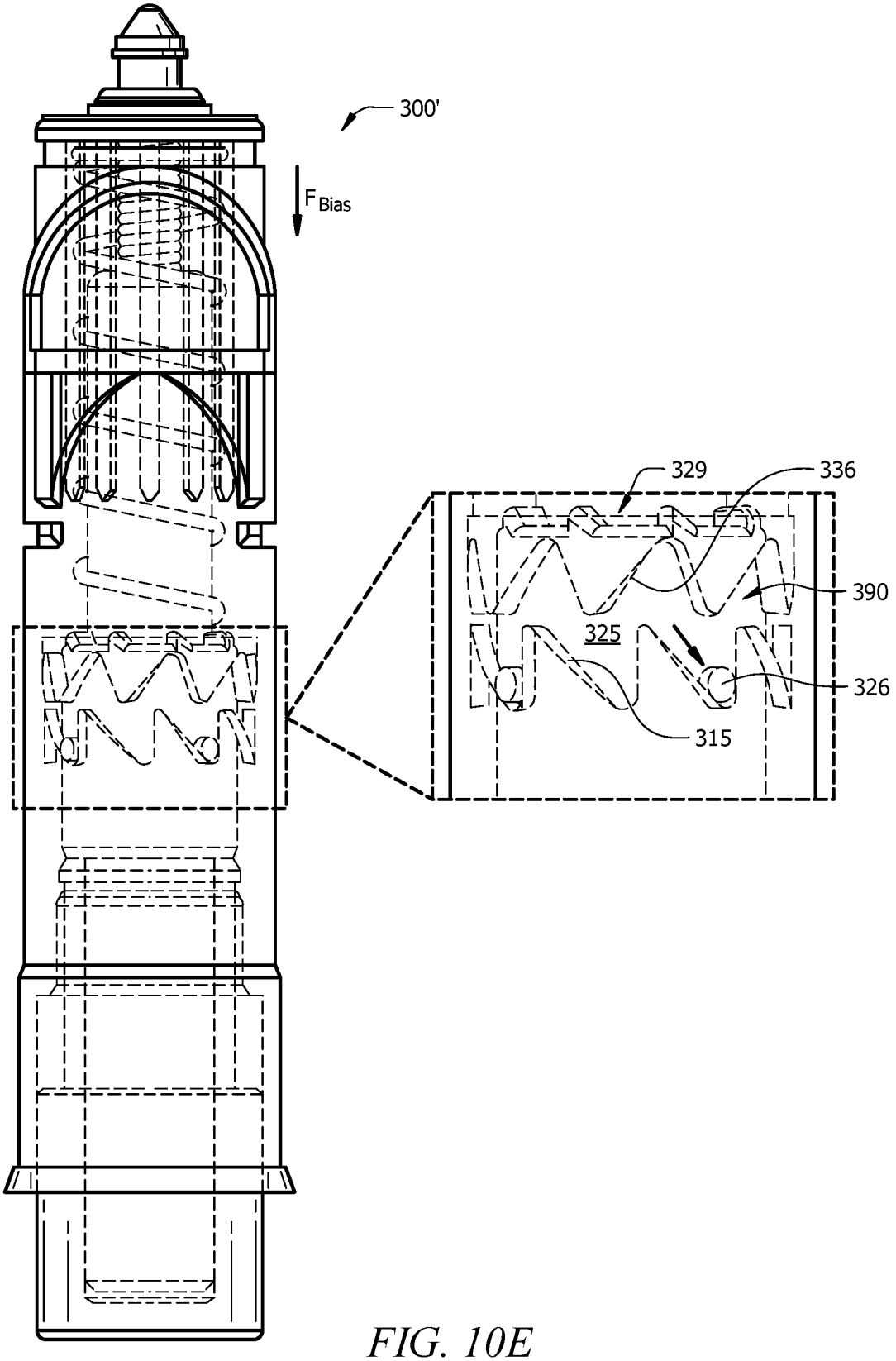

Thereafter, as the pushbutton 380 is released the bias force directs the pins 326 in a reverse direction towards the pushbutton 380 until the pins 326 encounter the sloped surface 315 along the annular irregular 314 recess in the base 310 as illustrated in FIG. 10D. As the bias force continues to push against the annular member 324 of the driver 320, the driver 320 further rotates anti-clockwise as the pins 326 are guided along the sloped surface 315 of the annular recess 314 of the base 310 until the pins 326 encounter the stop or substantially vertical surface in the base 310 as shown in FIG. 10E.

Figure 10F:
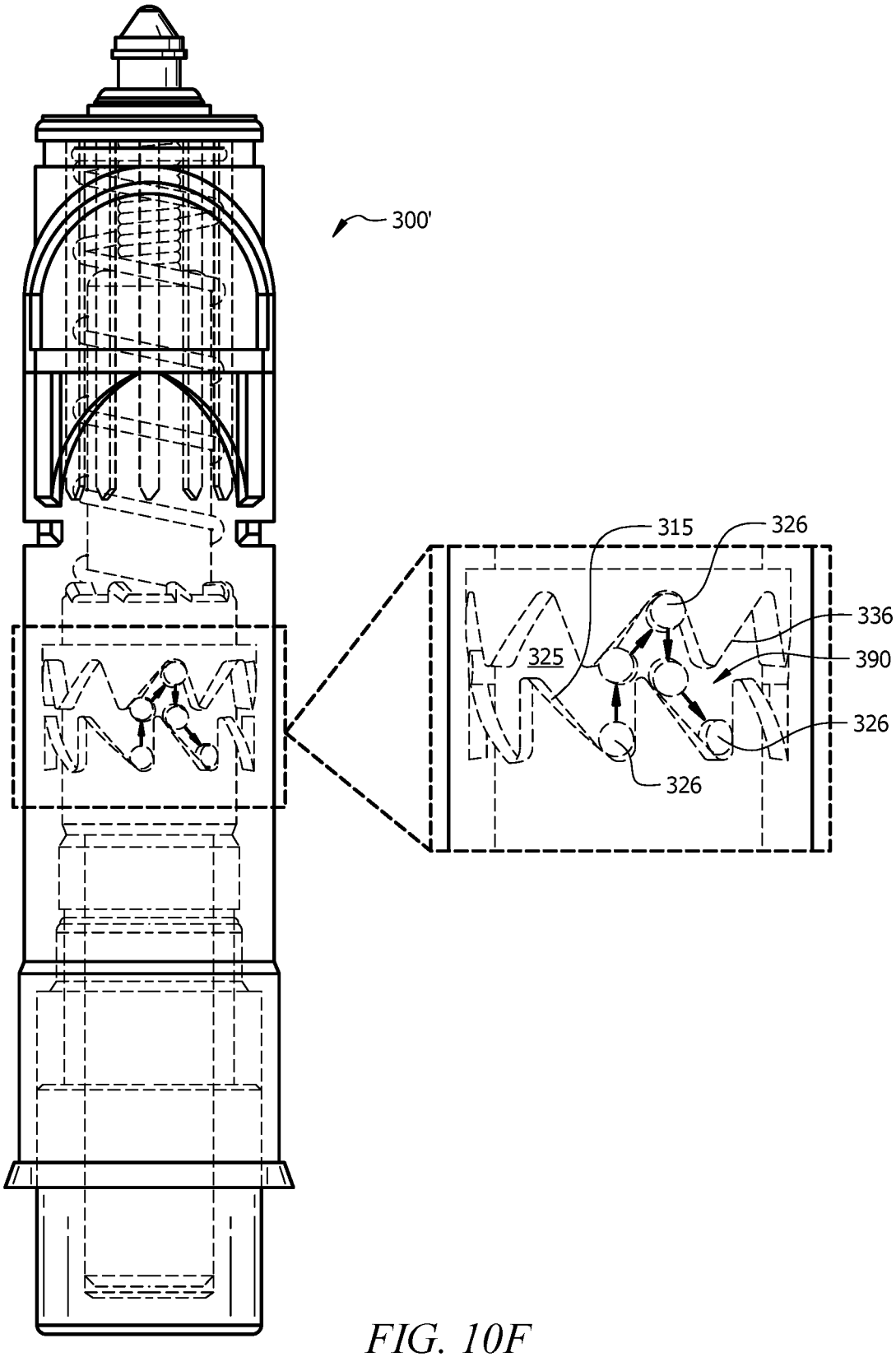

As illustrated in the detail of FIG. 10F, the pins 326 of the driver 320 traverse a path 390 between the opposed irregular surfaces of the base 310 and the coupler 330 with each depression and release of the pushbutton 380. As a result of the movement from a start position (FIG. 10A) to a stop position (FIG. 10E) the driver 320 rotates the threaded rod 360 through the threaded opening 338 of the coupler 330, which displaces the threaded rod 360 and the wiper 350 along the longitudinal axis 105 of the dispenser 100 toward the applicator 250.

It should be apparent that the slopes and lengths of the opposed guiding surfaces of the driver 320 and the base 310 may be adjusted as desired to achieve more or less rotation of the driver 320 and the threaded rod 360. In addition, the pitch of the internal thread of the coupler 330 and the pitch of the external thread of the rod 360 may be adjusted to change the longitudinal displacement of the threaded rod 360 and the wiper 350 that results from each push and release (or cycle) of the pushbutton 380.

In the above-described embodiment, the pump assembly 300' reduces or substantially avoids the generation of harsh sounds or other audible feedback.

As illustrated in FIG. 2, the pump assembly 300 may optionally be assembled with a sleeve 370 concentrically arranged about the tubular member 322 of the driver 320. FIGS. 9A through 9F illustrate features of the sleeve 370. The sleeve 370 may be constructed of various plastics including polyoxymethylene (POM). When assembled in the pump assembly 300, the sleeve 370 is fixed to or engaged with the coupler 330. The sleeve 370 includes an annular cam surface 375 an opposed annular surface 372 and a set of radially arranged appendages 371 that extend outwardly from the sleeve 370 and configured to closely fit within the channels between the radial appendages 331 of the coupler 330. The annular surface 372 is arranged to contact end 344 of the bias member 340. In this example embodiment, the annular member 324 of the driver 320 includes a respective cam surface 329 opposed to the annular cam surface 375 of the sleeve 370.

Figure 9A:
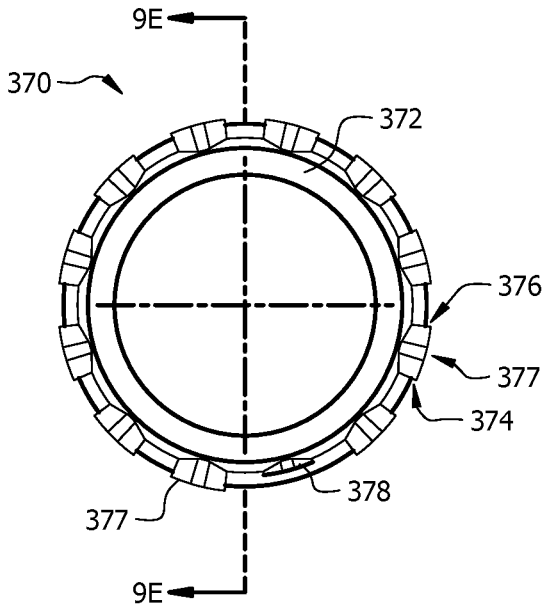
FIGS. 9A, 9B and 9C illustrate representative top, front and bottom plan views of the (optional) sleeve of FIG. 2.
Figure 9B:
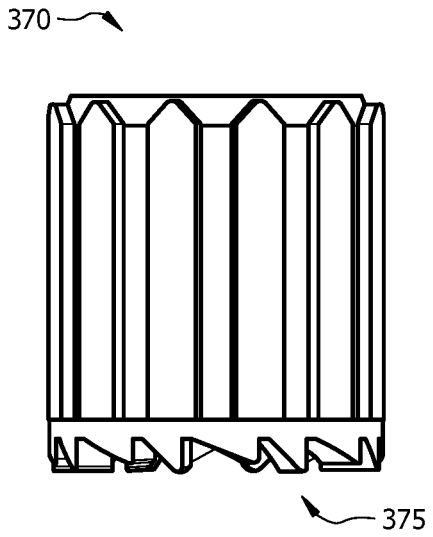
Figure 9C:
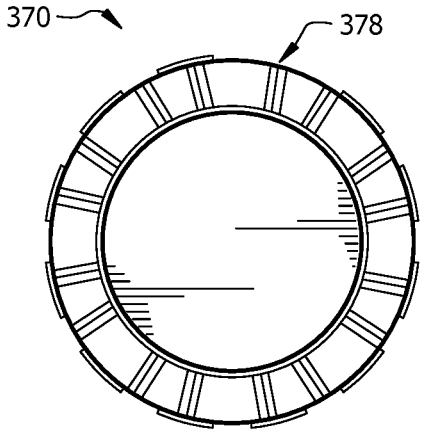
Figure 9D:
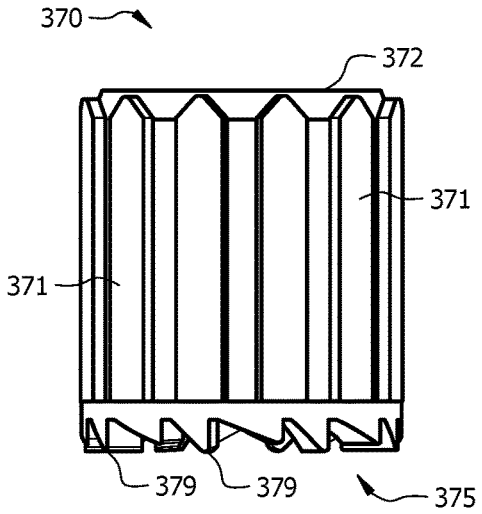
FIG. 9D illustrates a side view of the sleeve illustrated in FIGS. 9A, 9B and 9C.
Figure 9E:
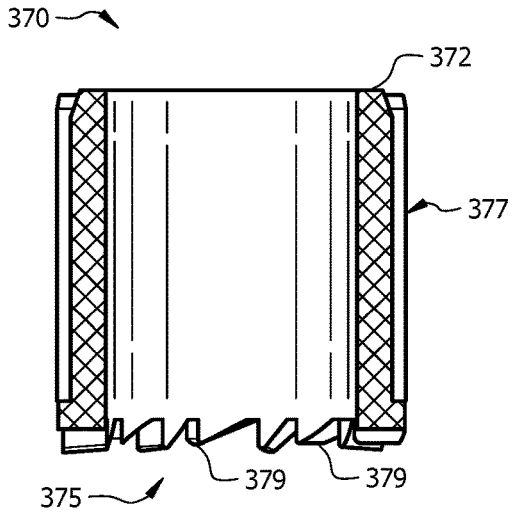
FIG. 9E is a cross-sectional view of the (optional) sleeve in the direction of line 9E-9E illustrated in FIG. 9A.
Figure 9F:
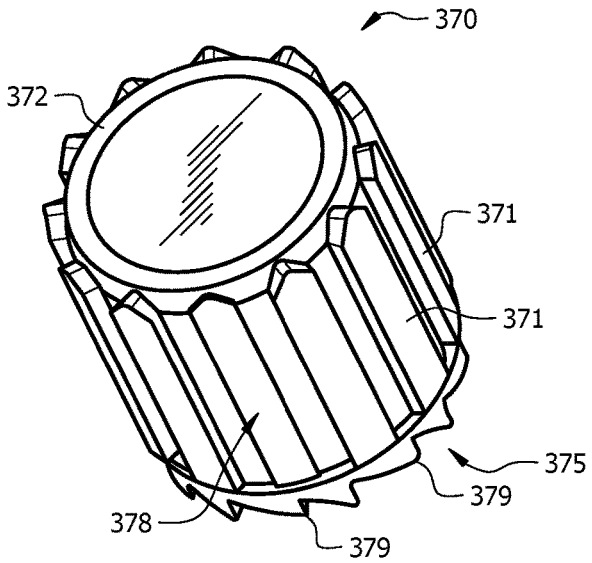
FIG. 9F is a perspective view of the (optional) sleeve illustrated in FIGS. 9A, 9B and 9C.

As illustrated in FIG. 9A, the radially distributed appendages 371 have surfaces 374, 376, 377 that are parallel to the longitudinal axis of the pump assembly 300 with surface 374 and surface 376 substantially parallel to each other and extending away from the sleeve 370 and an intersecting surface 377 located between the surfaces 374, 376. As illustrated in FIG. 9A, FIG. 9C and FIG. 9F at least one of the radially distributed appendages 371 defines a gate 378.

As shown in FIG. 9A, FIG. 9B, FIG. 9D, FIG. 9E, and FIG. 9F, the radially distributed appendages 371 are arranged with a pointed end proximal to the annular surface 372 of the sleeve 370. The respective pointed ends provide a guide to arrange each of the radially distributed appendages 371 into a corresponding channel between adjacent appendages 331 of the coupler 330.

As illustrated in FIG. 9B, FIG. 9C, FIG. 9D, FIG. 9E and FIG. 9F the annular cam surface 375 includes a plurality of extensions or points 379 that extend away from the sleeve 370. The annular cam surface 375 includes a set of sixteen points or extensions 379 that alternate in a respective separation distance from the annular surface 372. As shown, transitions in the annular can surface 375 from the points or extensions 379 in the direction of the annular surface 378 are substantially parallel to the surfaces 374, 376, 377. As further illustrated, transitions in the annular cam surface 375 from discontinuities relatively closer to the annular surface 378 to the respective points or extensions 379 alternate between a relatively steeper slope for transitions toward the points or extensions 379 that are furthest away from the annular surface 372 and a relatively less steep slope for transitions toward points or extensions 379 that are relatively closer to the annular surface 372. In other words, the annular cam surface 375 has appendages that are unevenly distributed with every adjacent transition having a different separation distance along the circumference of the cam surface 375 and every adjacent point or extension 379 having a different separation distance from the annular surface 372.

As shown schematically in FIGS. 11A through 11E, in this alternative embodiment of the pump assembly 300, the pins 326 of the driver 320 traverse a similar path 390 between the opposed irregular surfaces of the coupler 330 and the base 310 as presented in FIG. 10A through FIG. 10F. In addition, as further shown in the uppermost of the two details illustrated in FIG. 11A, a first cam surface 329 arranged along the annular member 324 of the driver 320 is in engagement with an opposed cam surface 375 of the sleeve 370, which is engaged to the coupler 330 and the base 310.

Figure 11A:
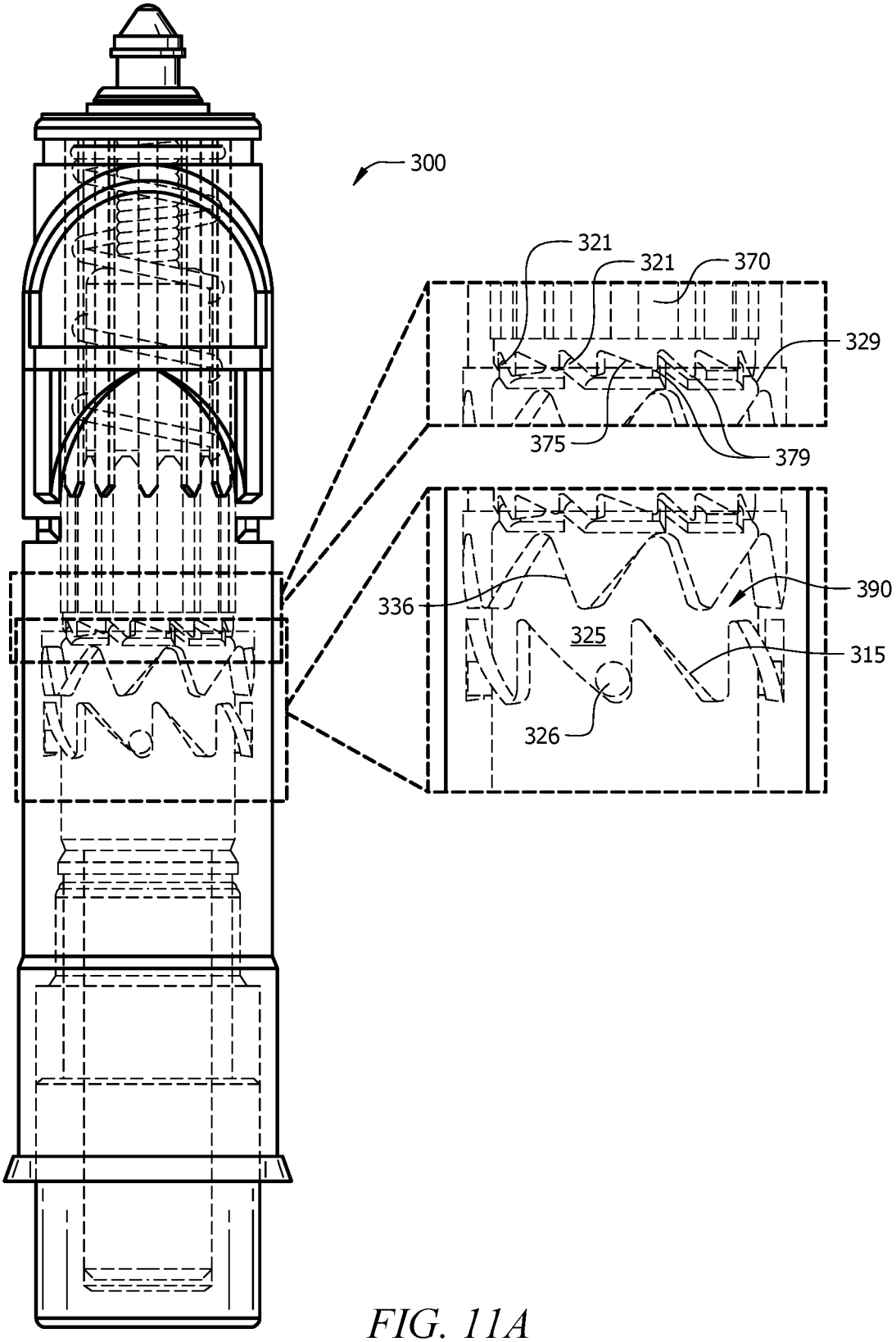
FIGS. 11A, 11B, 11C, 11D, 11E and 11F illustrate respective positions of the first cam of the driver with respect to the cam of the optional sleeve of FIG. 2.
Figure 11B:
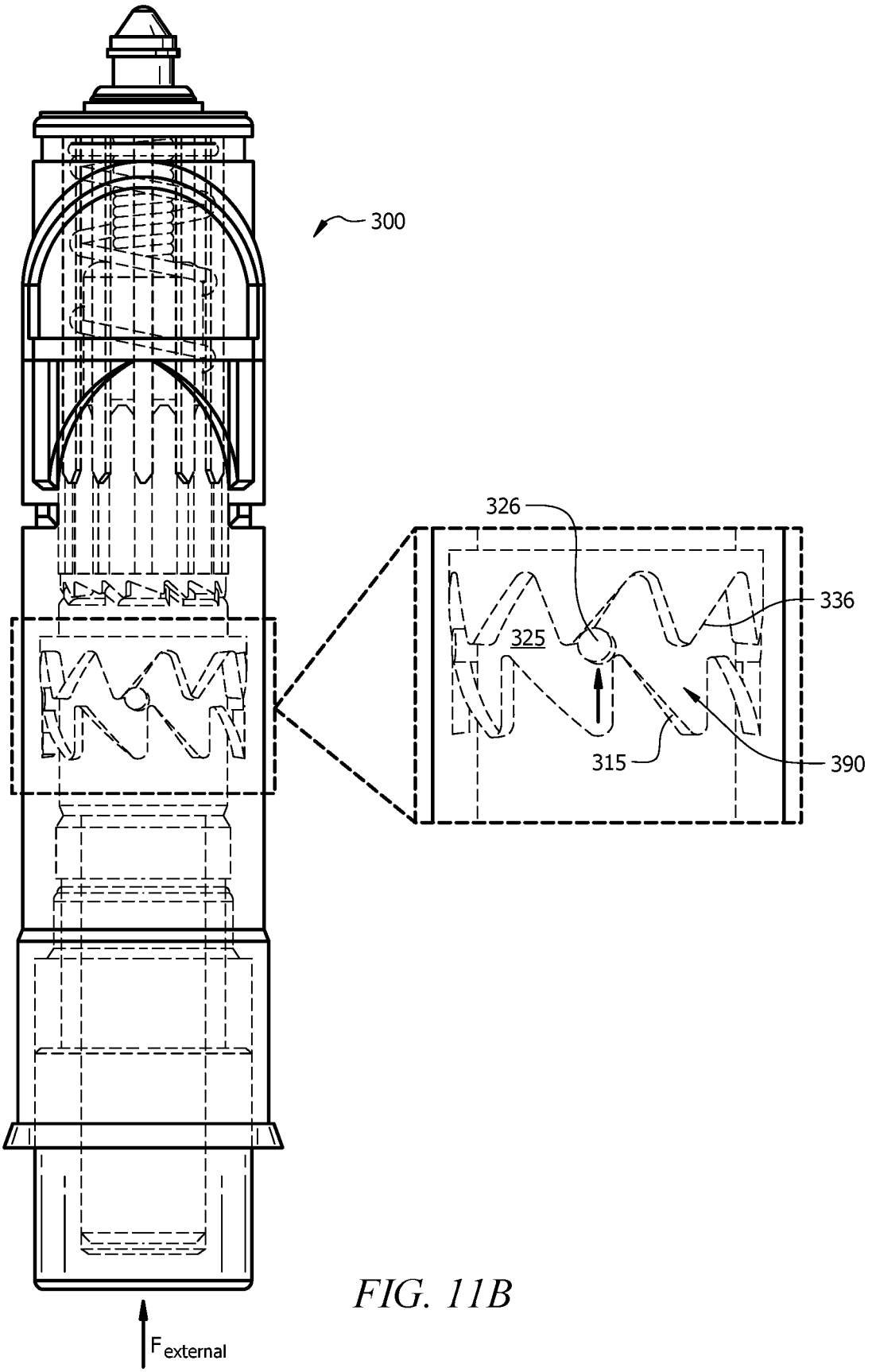
Figure 11C:
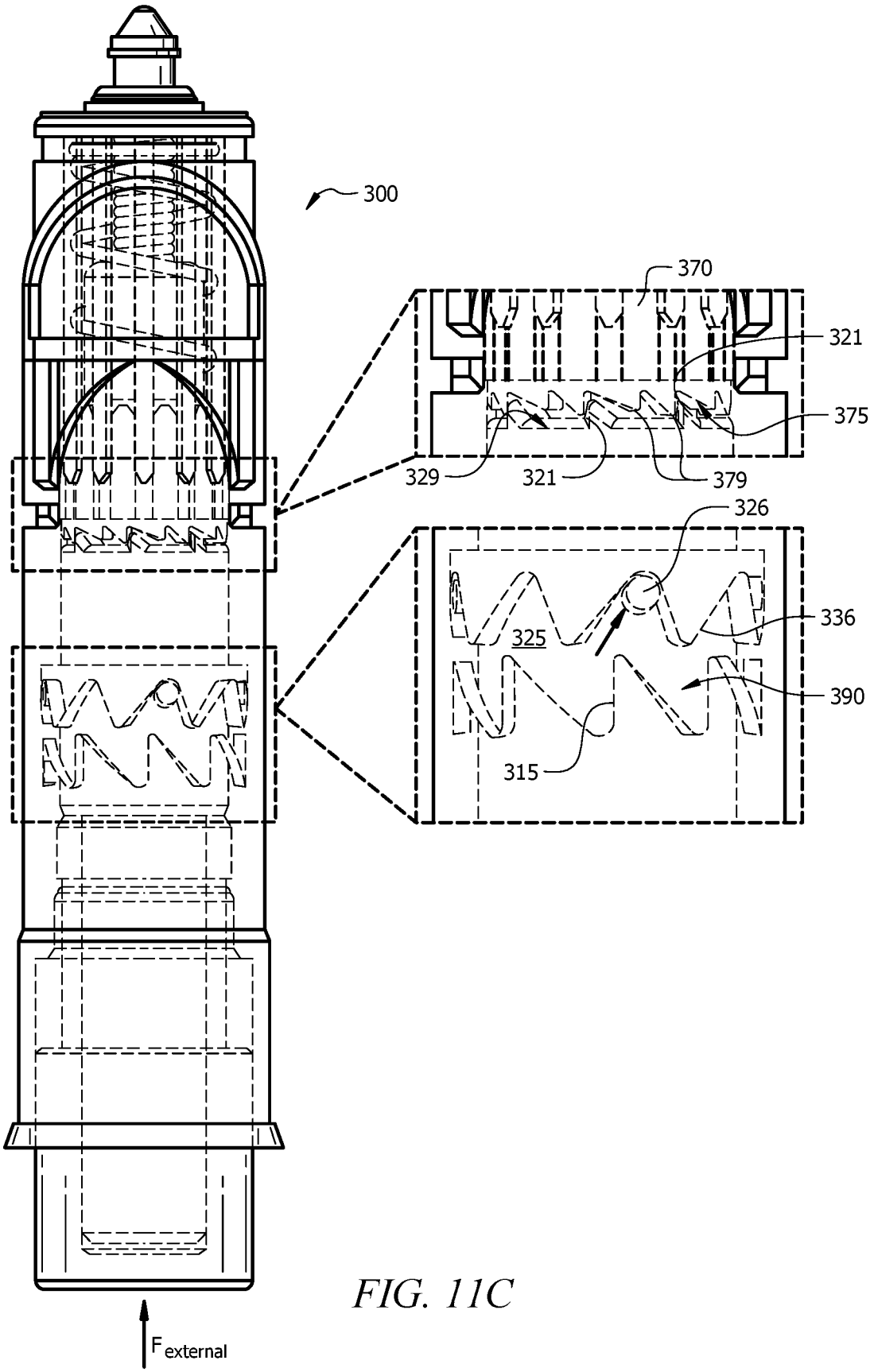
Figure 11D:
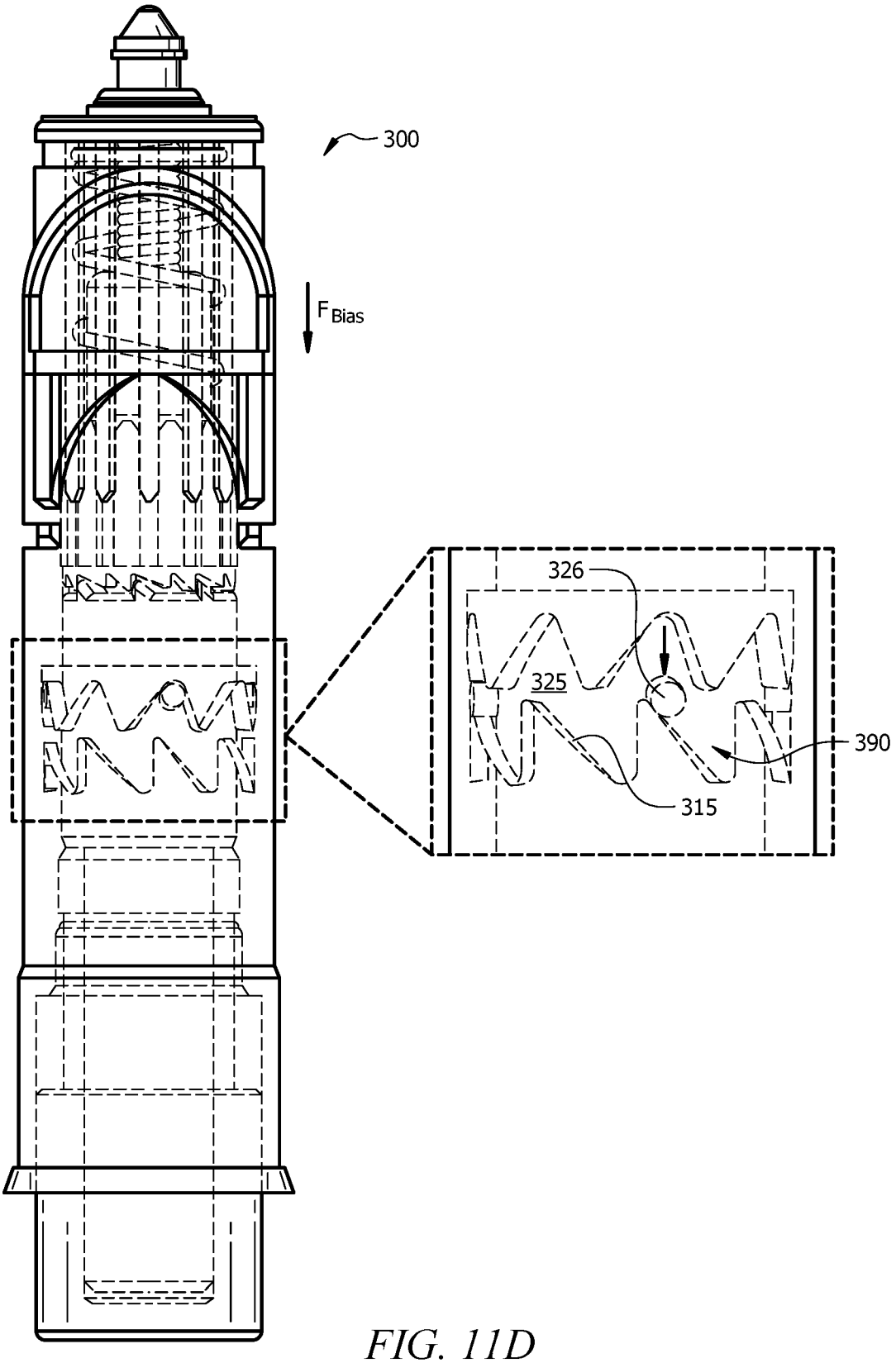

As a result of a longitudinal external force applied to the pushbutton 380 of the dispenser 100 that exceeds the bias force exerted by the bias member 340, the bias member 340 compresses and the pins 326 are displaced in a direction parallel to the longitudinal axis 105 of the dispenser 100 toward a first intermediate position of the pins 326 as illustrated in FIG. 11B. Once the pins 326 contact the sloped surface of the annular member 334 of the coupler 330, the driver 320 rotates as the pushbutton 380 is further depressed until the pins 326 reach the second intermediate position as illustrated in FIG. 11C.

Figure 11E:
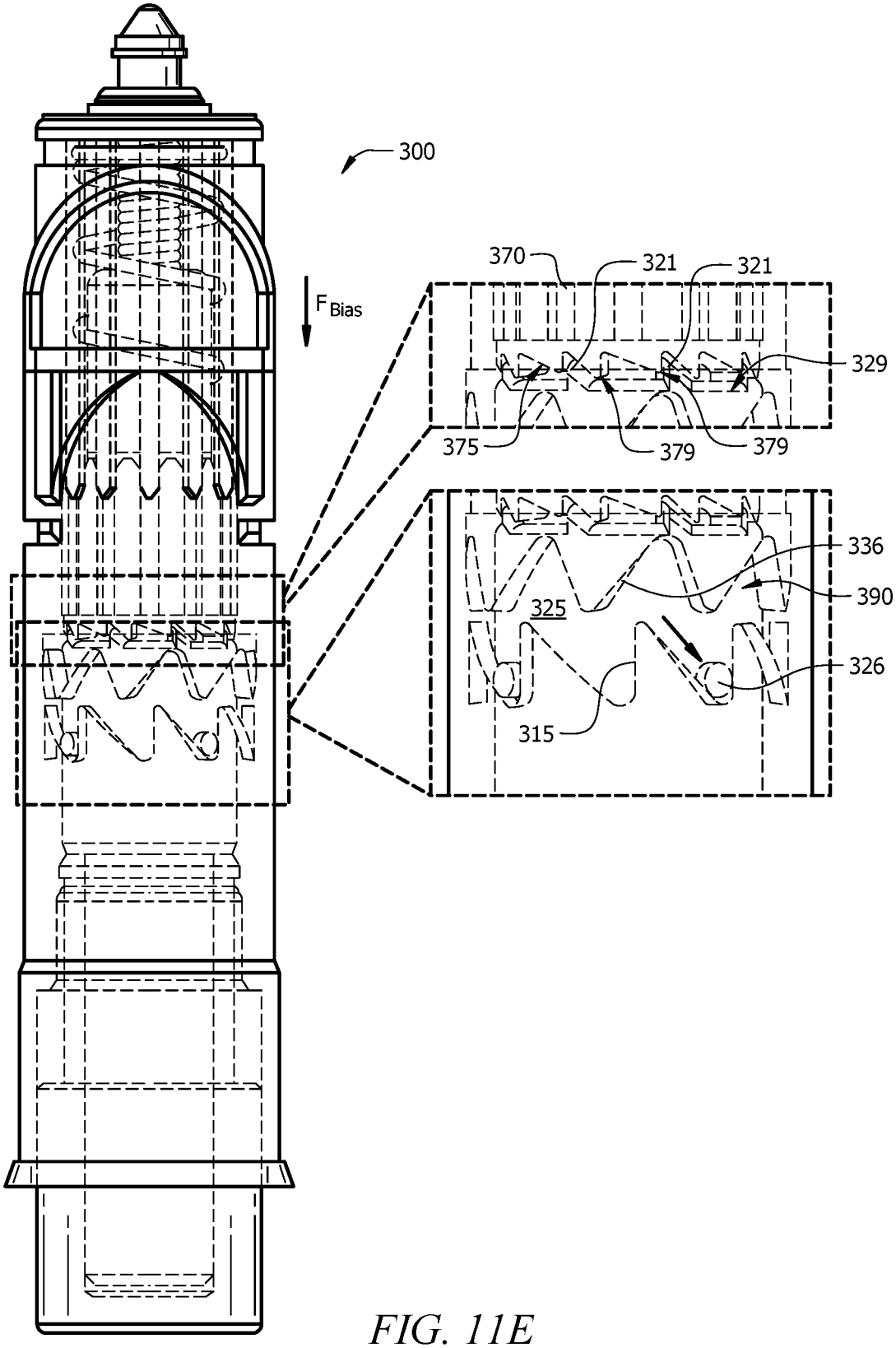
Figure 11F:
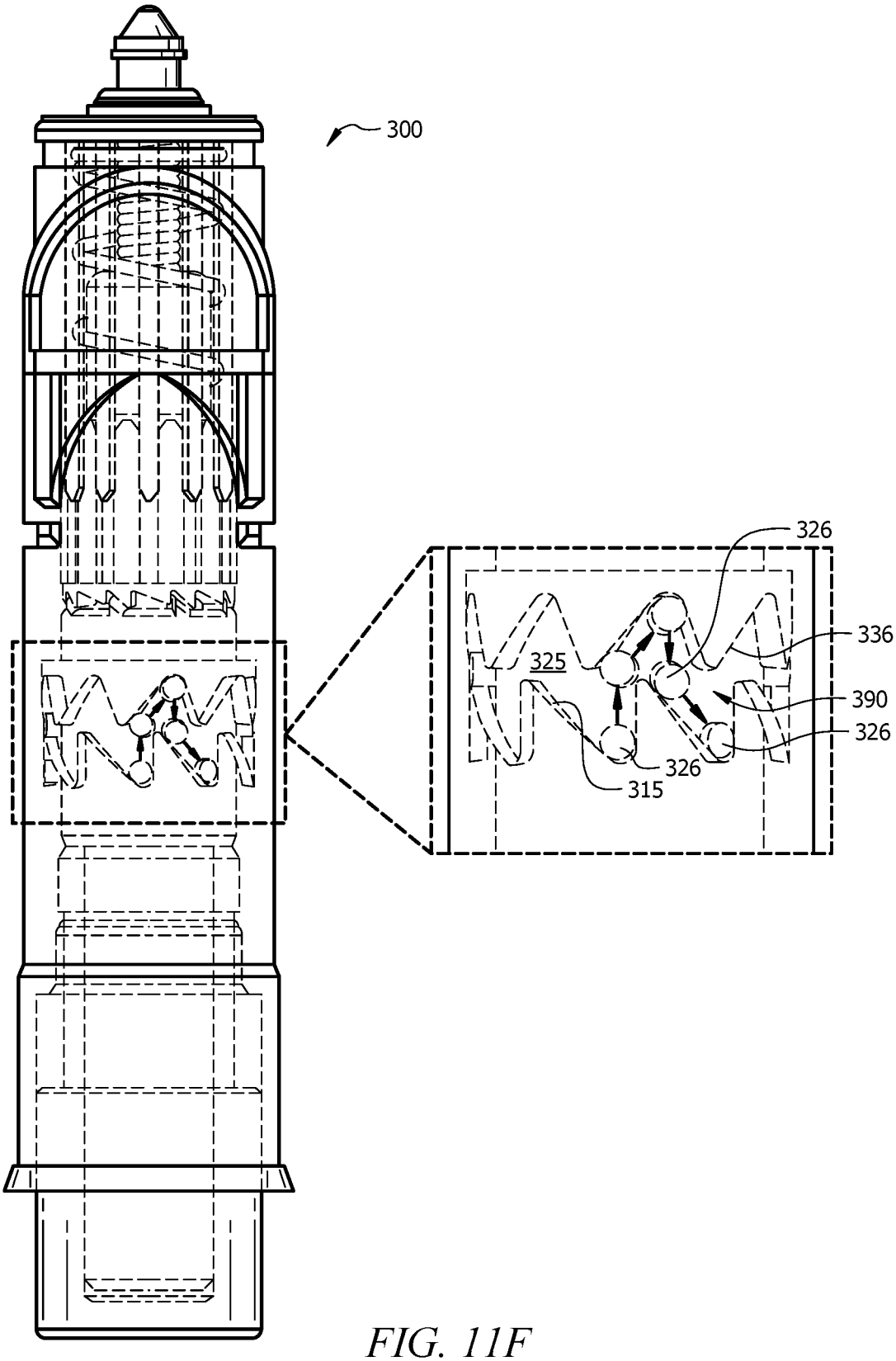

As shown in the uppermost insert of FIG. 11A, the first cam surface 329 of the driver 320 engages the complimentary annular cam surface 375 of the sleeve 370. Thereafter, the driver 320 rotates anti-clockwise. As illustrated in FIG. 11C, the pins 326 follow the irregular annular surface 334 of the coupler 330 and sliding contact of the respective sloped surfaces of the first cam 329 past the fixed cam surface 375 of the sleeve 370 produce an audible "click" or "pop" as an apex 321 of the cam surface 329 passes an apex 379 of the fixed cam surface 375 of the sleeve 370. As further shown in FIG. 11D, subsequent removal of the longitudinal force against the pushbutton 380 causes the bias force to direct the pins 326 to contact the irregular annular recess 334. As the bias force continues to push against the annular member 324 of the driver 320, the driver 320 rotates and the pins 326 are guided along the sloped surface 314 in the recess of the base 310 until the pins 326 encounter the stop surface in the base 310 as shown in FIG. 11E. As the driver 320 rotates anti-clockwise with respect to the fixed sleeve 370, the appendages 321 along the first cam 329 create an audible "snap" or "click" as they advance past the opposed points 379 of the second cam surface 375. As the driver 320 rotates the threaded rod 360 advances and translates the wiper 350 into the reservoir 150. Movement of the wiper 350 is a function of the rotation in degrees of the driver 320 and threaded rod 360 divided by 360° multiplied by the pitch of the threaded surface in the opening 338 of the coupler 330.

It should be noted that the term "comprising" does not exclude other elements or features and the article "a" or "an" does not exclude a plurality. Also elements described in association with different embodiments may be combined. As also explained, the pump assembly may be replaced in its entirety by one or more elements arranged to advance a stored liquid in the direction of the improved transfer assembly.

I claim:

1. A dispenser, comprising:

a hollow body having a first end and an opposed base end, a portion of the hollow body providing a surface defining a reservoir; and a transfer assembly a section of which is coupled to a support section of the hollow body and arranged to deliver a stored liquid from the reservoir to an applicator, the transfer assembly having an adapter in contact with the hollow body at the first end, the adapter having a central member forming orifices to fluidly couple an inlet to an outlet, an applicator base supported by and extending beyond the adapter, the applicator base forming a cavity therein, a piston having a head portion arranged within the cavity of the applicator base; and a bias member arranged within the cavity of the applicator base and contacting the head portion of the piston.

2. The dispenser of claim 1, wherein the central member has a seal surface.

3. The dispenser of claim 2, wherein under fluid pressure displacement of the piston in a direction toward the bias member enables fluid communication from an inlet to an outlet of the applicator base.

4. The dispenser of claim 3, wherein the inlet of the applicator base is in fluid communication with a first cavity partially defining a first volume and the outlet of the applicator base is in fluid communication with a second cavity partially defining a second volume.

5. The dispenser of claim 4, wherein the first volume is greater than the second volume.

6. The dispenser of claim 2, wherein the central member separates the inlet of the adapter from the outlet of the adapter and extends from the inlet of the adapter toward the outlet of the adapter.

7. The dispenser of claim 2, wherein the central member includes an extension that is dome shaped.

8. The dispenser of claim 2, wherein an apex of the central member is proximal to a longitudinal axis of the adapter.

9. The dispenser of claim 1, wherein the piston has a tubular member extending from the head portion.

10. The dispenser of claim 9, wherein the tubular member is arranged with at least two appendages proximal to an end opposed to the head portion.

11. The dispenser of claim 9, wherein the head portion of the piston forms an opening in fluid communication with the tubular member.

12. The dispenser of claim 9, wherein the tubular member of the piston has an external diameter that is less than a diameter of the head portion of the piston.

13. The dispenser of claim 9, wherein a diameter of the inlet portion of the adapter is greater than an inner diameter of the tubular member of the piston.

14. The dispenser of claim 1, wherein a cyclical modification of fluidic pressure in the reservoir provides at least a portion of a stored liquid at a surface of the applicator in less than about 20 cycles.

15. The dispenser of claim 14, wherein the cyclical modification of the fluidic pressure provides liquid at the surface of the applicator in less than about 10 cycles.

16. The dispenser of claim 1, wherein a cyclical modification of fluidic pressure in the reservoir is responsive to operation of a manipulator of a pump assembly.

17. The dispenser of claim 1, wherein when a fluidic pressure in the reservoir exceeds a bias force induced by the bias member, the piston is displaced toward the applicator such that the head portion of the piston no longer contacts a seal surface of the central member and liquid enters a piston cavity.

18. The dispenser of claim 17, wherein when the fluidic pressure decreases below the bias force and liquid is present in the piston cavity, the head portion of the piston contacts the seal surface of the central member sealing the reservoir from the liquid present in the piston cavity.

19. The dispenser of claim 1, wherein an inlet diameter is smaller than an outlet diameter.

20. The dispenser of claim 1, wherein the head portion of the piston closely contacts a surface of the applicator base.

* * * * *